US009342040B2

(12) United States Patent
Niikawa et al.

(10) Patent No.: US 9,342,040 B2
(45) Date of Patent: May 17, 2016

(54) IMAGE FORMING APPARATUS AND CARTRIDGE

(71) Applicant: CANON KABUSHIKI KAISHA, Tokyo (JP)

(72) Inventors: Yusuke Niikawa, Kawasaki (JP); Daisuke Yamamoto, Yokohama (JP); Takeshi Arimitsu, Odawara (JP); Isao Koishi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/103,974

(22) Filed: Dec. 12, 2013

(65) Prior Publication Data

US 2014/0161489 A1 Jun. 12, 2014

(30) Foreign Application Priority Data

Dec. 12, 2012 (JP) ..... 2012-271267
Nov. 8, 2013 (JP) ..... 2013-232108

(51) Int. Cl.
*G03G 15/00* (2006.01)
*G03G 21/16* (2006.01)
*G03G 21/18* (2006.01)

(52) U.S. Cl.
CPC ..... *G03G 21/1647* (2013.01); *G03G 21/1857* (2013.01)

(58) Field of Classification Search
CPC ..... G03G 21/1803; G03G 21/1857; G03G 21/186; G03G 21/1864; G03G 21/1884; G03G 21/1861
See application file for complete search history.

(56) References Cited

U.S. PATENT DOCUMENTS 5,887,227 A 3/1999 Kawai et al.
6,535,709 B2 3/2003 Yokomori et al.
6,622,001 B2 9/2003 Arimitsu et al.
8,687,984 B2 4/2014 Kamoshida et al.
2005/0260010 A1* 11/2005 Yokota ..... G03G 21/186 399/111
2008/0317512 A1* 12/2008 Mase ..... G03G 15/082 399/263
2010/0239311 A1* 9/2010 Kikuchi ..... G03G 15/1605 399/111
2013/0259532 A1* 10/2013 Kubota ..... G03G 21/1676 399/254
2014/0050502 A1* 2/2014 Tsuritani ..... G03G 15/0832 399/90

FOREIGN PATENT DOCUMENTS

JP 07-077921 A 3/1995
JP 10-162684 A 6/1998
JP 2002-116668 A 4/2002

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus for forming an image on a recording material includes a mounting portion to which a cartridge is detachably mounted and a drive transmission member for transmitting a driving force by being engaged with a drive-transmitted member provided on the cartridge when the cartridge is mounted to the mounting portion. In addition, a protecting member is movable between a protecting position where the drive transmission member is prevented from being exposed toward the mounting portion and an open position where the protecting member is retracted from the protecting position to expose the drive transmission member to the mounting portion thereby to permit engagement of the drive transmission member with the drive-transmitted member.

18 Claims, 20 Drawing Sheets

(a)

(b)

(a)

(b)

(a)

(b)

(a)

(b)

(c)

(a)

(b)

IMAGE FORMING APPARATUS AND CARTRIDGE

FIELD OF THE INVENTION AND RELATED ART

The present invention relates to an image forming apparatus for forming an image on a recording material (medium) and relates to a cartridge.

Here, the image forming apparatus in an apparatus for forming the image on the recording material by using known various image forming principles and types (processes) such as an electrophotographic process, an electrostatic recording process and a magnetic recording process. The image forming apparatus includes, e.g., a copying machine, a printer (a laser (beam) printer, an LED printer, or the like), a facsimile machine, an image display apparatus (electronic blackboard or electronic white board) and the like. On the recording material, the image is formed by the image forming apparatus, and the recording material may include, e.g., a sheet, an OHT sheet, an image displaying material, and the like.

The cartridge is prepared by integrally assembling, into a cartridge (unit), a part or all of an image forming portion including an image bearing member for forming an image and an image forming process means actable on the image bearing member. Further, the cartridge is detachably mounted in an apparatus main assembly of the image forming apparatus, and contributes to an image forming process for forming the image on the recording material. The apparatus main assembly is an image forming apparatus constituent portion excluding the cartridge in the image forming apparatus of the cartridge type.

Accordingly, the process cartridge includes a cartridge which is prepared by integrally assembling the electrophotographic photosensitive member and the developing means as the process means into a cartridge, which is detachably mountable to the apparatus main assembly.

As the image bearing member, it is possible to use an electrophotographic member in the electrophotographic process, an electrostatic recording dielectric member in the electrostatic recording process, a magnetic recording magnetic material in the magnetic recording process, and members capable of forming the image by other various image forming principles and types. The image forming process means is a device for forming the image by acting on the image bearing member.

In the following, for convenience, an electrophotographic image forming apparatus of the cartridge type will be described as an example. As the cartridge, e.g., a process cartridge or a developing cartridge may be cited.

The process cartridge is prepared by integrally assembling, into a cartridge, an electrophotographic photosensitive member and, as an electrophotographic process means actable on the member, at least one of a charging means, a developing means and a cleaning means, and is detachably mountable to the apparatus main assembly of the electrophotographic image forming apparatus.

Further, the process cartridge includes a cartridge which is prepared by integrally assembling, into a cartridge, an electrophotographic photosensitive member and, as the process means actable on the member, the charging means, the developing means or the cleaning means, and is detachably mountable to the apparatus main assembly of the electrophotographic image forming apparatus.

The process cartridge integrally including the electrophotographic photosensitive member and the developing means is referred to as a so-called integral type process cartridge.

Further, the process cartridge integrally including the electrophotographic photosensitive member and the process means other than the developing means is referred to as a so-called (function) separation type process cartridge. That is, the developing means is provided in a developing unit other than the process cartridge, and the process cartridge for forming the image by being paired with the developing unit is referred to as the so-called separation type process cartridge.

Further, the developing cartridge includes a developer carrying member (hereinafter referred to as a developing roller) for supplying the developer to the electrophotographic photosensitive member. Further, the developing cartridge accommodates a powdery developer (toner) used for developing an electrostatic latent image, formed on the electrophotographic member, by the developing roller, and is detachably mountable to the apparatus main assembly.

In the case of the developing cartridge, the electrophotographic member is mounted in the apparatus main assembly or a cartridge supporting member. Alternatively, the electrophotographic photosensitive member is provided in the so-called separation type process cartridge described above. In this case, the process cartridge does not include the developing means.

Therefore, the cartridge includes the above-described so-called integral type process cartridge or the above-described so-called separation type process cartridge. Further, the cartridge includes the case where the so-called separation type process cartridge and the developing cartridge are used in a pair. Further, the cartridge includes the case where the electrophotographic member is fixedly mounted in the apparatus main assembly or the cartridge supporting member and the developing cartridge is used so as to be actable on the electrophotographic photosensitive member and so as to be detachably mountable. Further, the cartridge includes a unit, detachably mountable to the apparatus main assembly, which contributes to the image forming process for forming the image on the recording material.

According to this cartridge type, maintenance of the image forming apparatus can be performed by an operator (user) himself (herself) without relying on a serviceperson, and therefore operatively was able to be remarkably improved. Therefore, the cartridge type has been widely used in the image forming apparatus.

The cartridge is mountable to the apparatus main assembly of the image forming apparatus, and therefore as a transmitting means for transmitting a driving force from the apparatus main assembly side to the cartridge, various drive transmitting means are used. A drive transmission portion is required to establish connection between the apparatus main assembly side and the cartridge side during insertion of the cartridge into the apparatus main assembly. For that reason, a drive transmission member (drive transmission portion) in the apparatus main assembly side is open in a state in which the cartridge is unmounted to the apparatus main assembly.

For this reason, the operator is capable of easily touching the drive transmission member in the apparatus main assembly side. Further, in a state in which the operator touches the drive transmission member, when the apparatus main assembly causes a malfunction, there is a possibility that the operator touches the drive transmission member during rotation.

Therefore, in order to prevent the apparatus main assembly from causing the malfunction, a method in which electric power supply to a motor is blocked by using an interlocking switch or the like, in the case where an openable door for permitting demounting and mounting of the cartridge is opened, to prevent the drive transmission member from rotating is used in general (Japanese Laid-Open Patent Application (JP-A) Hei 10-162684 and JP-A 2002-116668).

However, in JP-A Hei 10-162684 and JP-A 2002-116668, in an open state of the openable door and in an unmounted state of the cartridge, the drive transmission member is exposed to a cartridge mounting portion. For that reason, the operator can touch the drive transmission member, so that there is a possibility that the drive transmission member is erroneously damaged. Further, in JP-A Hei 10-162684 and JP-A 2002-116668, an electrical part such as the interlocking switch was used, and thus caused an increase in cost.

The present invention has been accomplished in order to solve the above-described problems of the conventional constitutions.

A principal object of the present invention is not only to prevent an operator from accessing to a drive transmitting member by an inexpensive constitution but also to protect the drive transmitting member.

According to an aspect of the present invention for achieving the above object, there is provided an image forming apparatus for forming an image on a recording material, comprising: a mounting portion to which a cartridge is detachably mounted; a drive transmission member for transmitting a driving force by being engaged with a drive-transmitted member provided on the cartridge when the cartridge is mounted to the mounting portion; and a protecting member movable between a protecting position where said drive transmission member is prevented from being exposed toward said mounting portion and an open position where said protecting member is retracted from the protecting position to expose said drive transmission member to said mounting portion thereby to permit engagement of said drive transmission member with the drive-transmitted member.

According to another aspect of the present invention for achieving the above object, there is provided a cartridge detachably mountable to a main assembly of an image forming apparatus for forming an image on a recording material, includes: a mounting portion to which a cartridge is detachably mounted; a drive transmission member; and a protecting member movable between a protecting position where said drive transmission member is prevented from being exposed toward said mounting portion and an open position where the protecting member is retracted from the protecting position to expose the drive transmission member to the mounting portion thereby to permit engagement of the drive transmission member with the drive-transmitted member, the cartridge comprising: the drive-transmitted member for receiving a driving force by being engaged with the drive transmission member when the cartridge is mounted to the mounting portion, wherein the drive-transmitted member is engageable with the drive transmission member by mounting the cartridge to the mounting portion to retract the protecting member from the protecting position to the open position.

These and other objects, features and advantages of the present invention will become more apparent upon a consideration of the following description of the preferred embodiments of the present invention taken in conjunction with the accompanying drawings.

Figure 2:
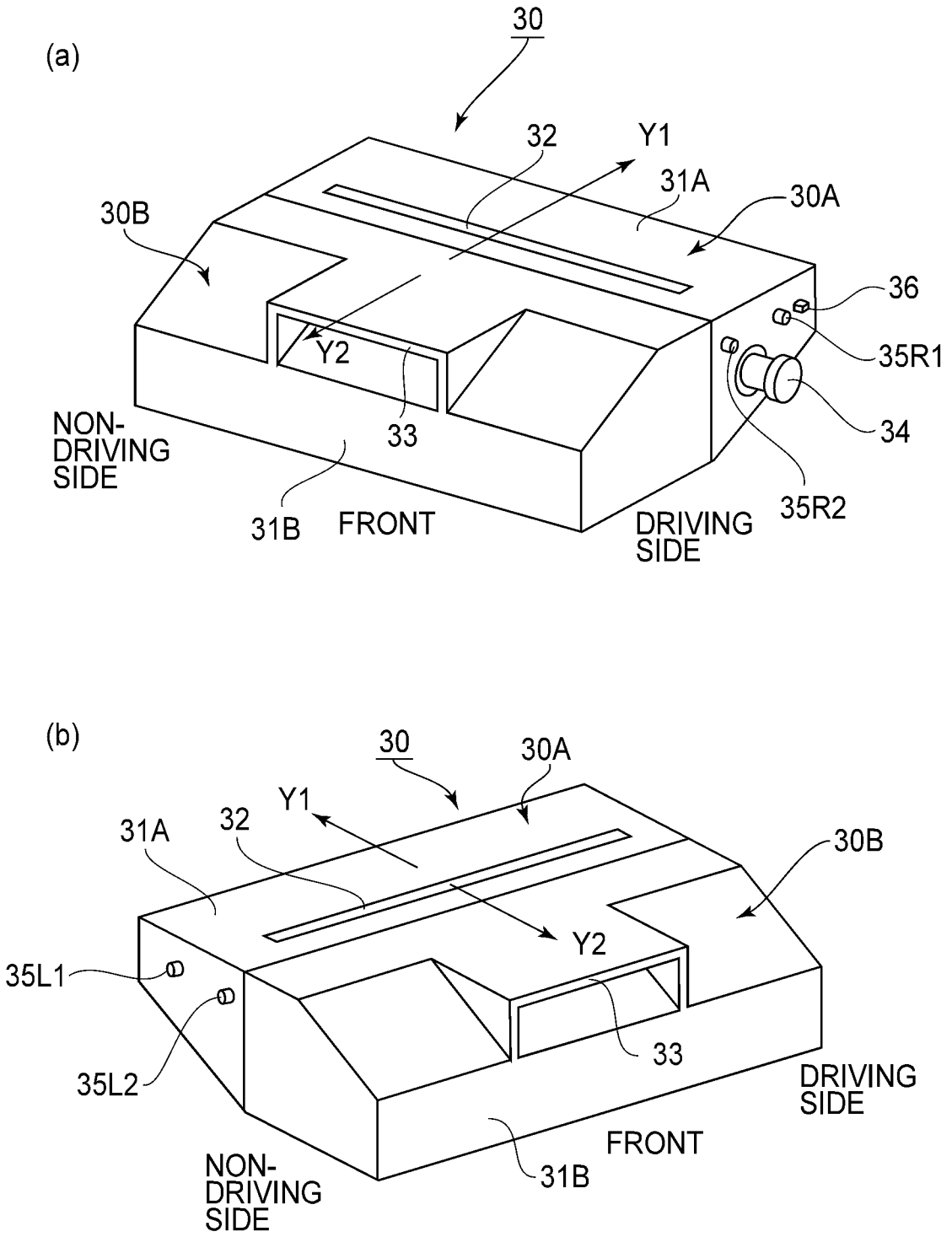

Part (a) of FIG. 2 is a perspective view of an outer appearance of a cartridge as seen from a longitudinal end side (driving side), and (b) of FIG. 2 is a perspective view of the outer appearance of the cartridge as seen from the other longitudinal end side (non-driving side).

Figure 3:
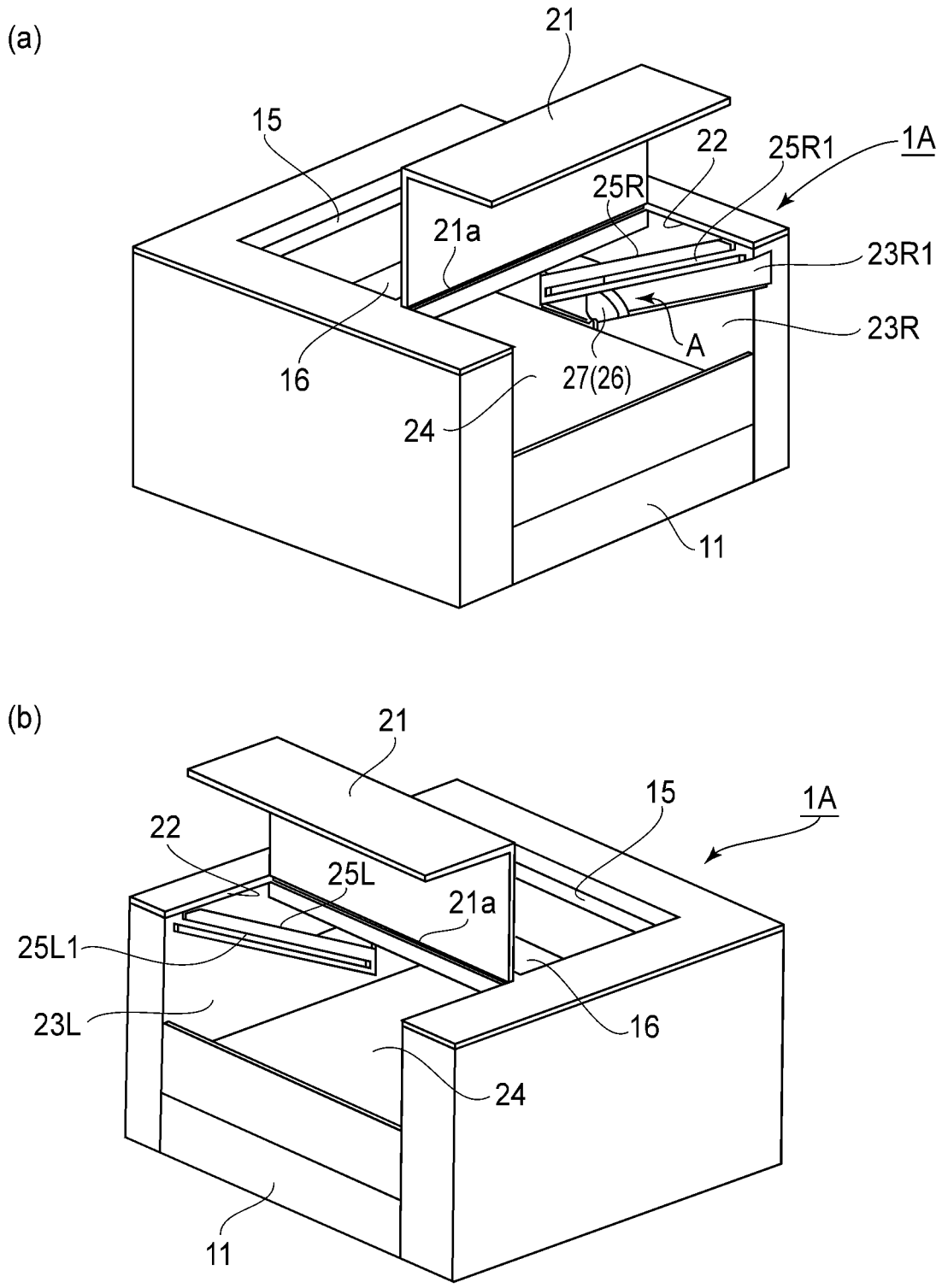

Parts (a) and (b) of FIG. 3 are perspective views showing an open state of an openable door in a condition (state) in which the cartridge is not mounted to the apparatus main assembly, wherein (a) is a perspective view showing an inner surface of a right side plate in a driving side of the apparatus main assembly, and (b) is a perspective view showing an inner surface of a left side plate in a non-driving side of the apparatus main assembly.

Figure 4:
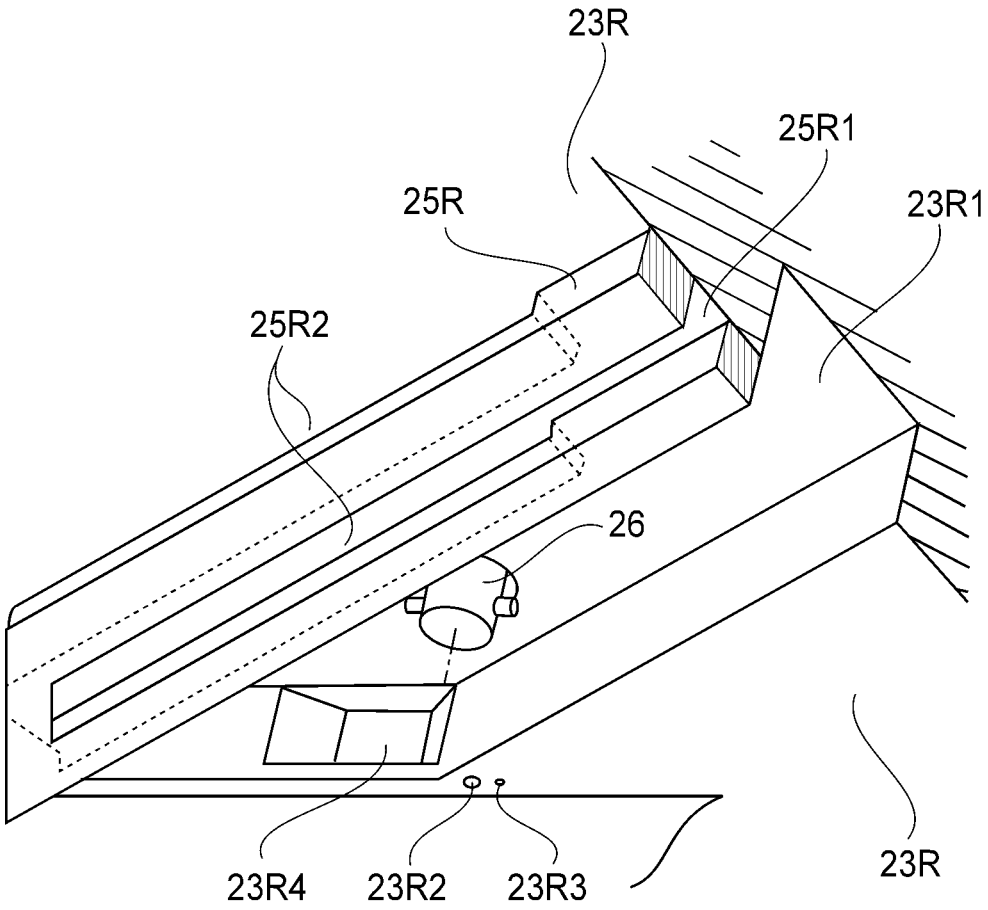

FIG. 4 is a perspective view of a principal portion of a right-side cartridge guiding member.

Figure 5:
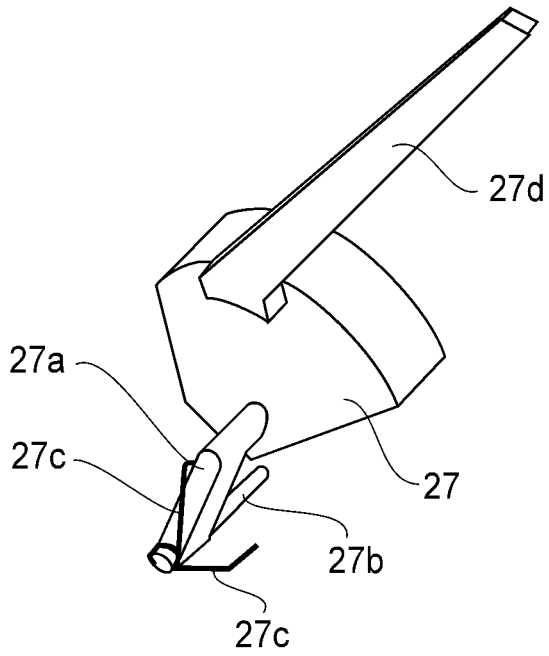
Figure 5:
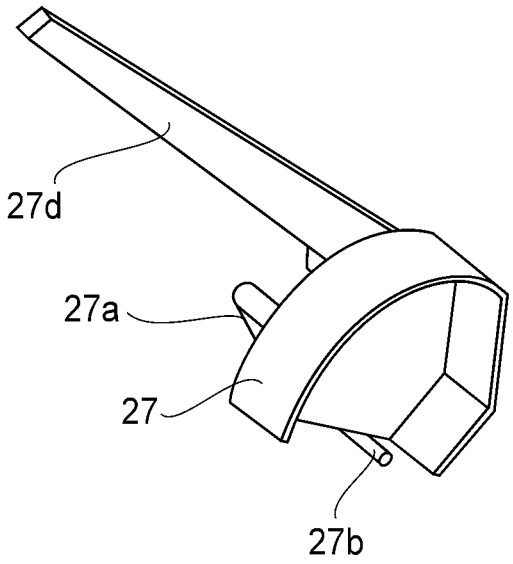

Part (a) of FIG. 5 is a perspective view of a cover as a protecting member as seen from an outside, and (b) of FIG. 5 is a perspective view of the cover as the protecting member as seen from an inside.

Figure 6A:
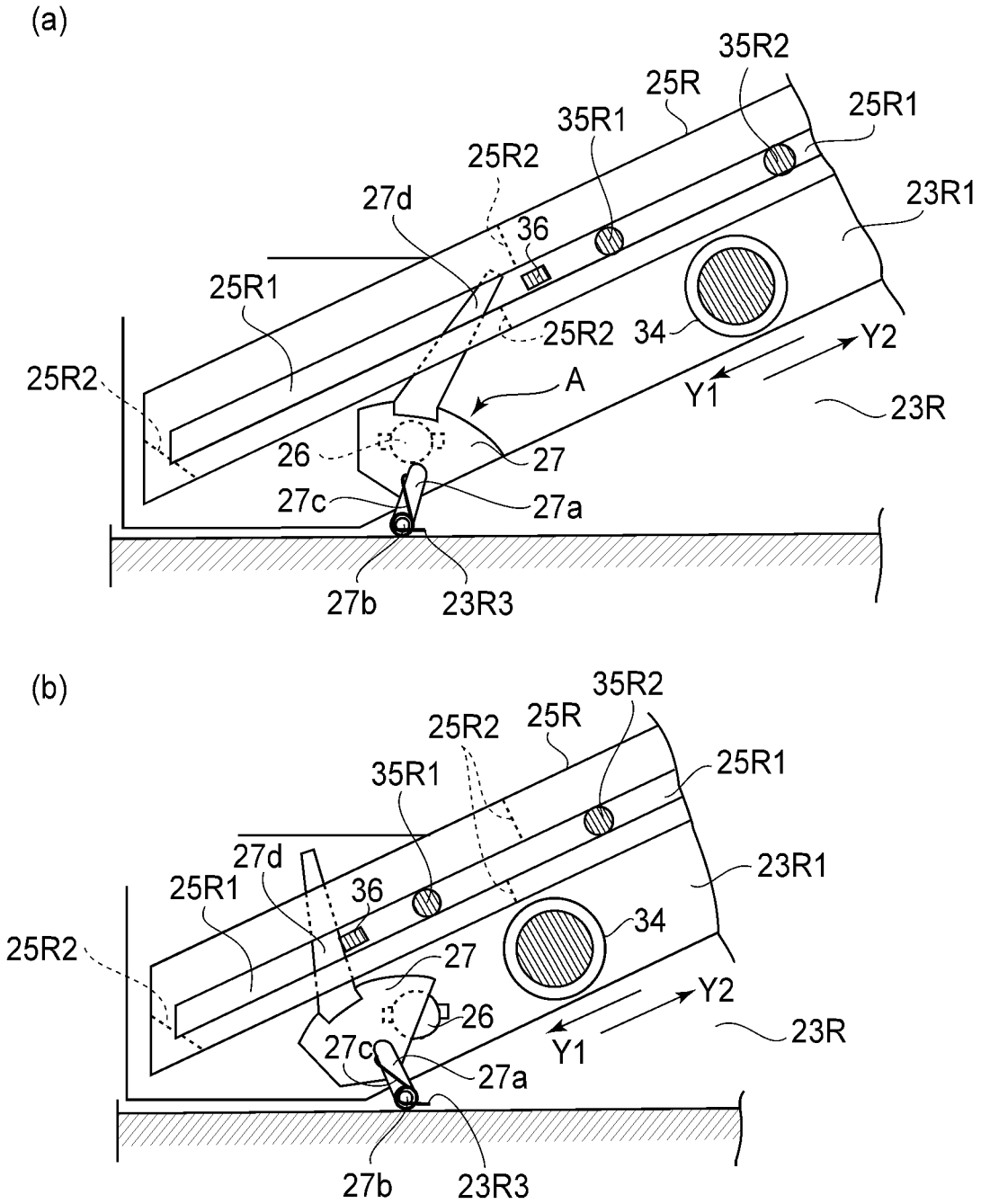
Figure 6B:
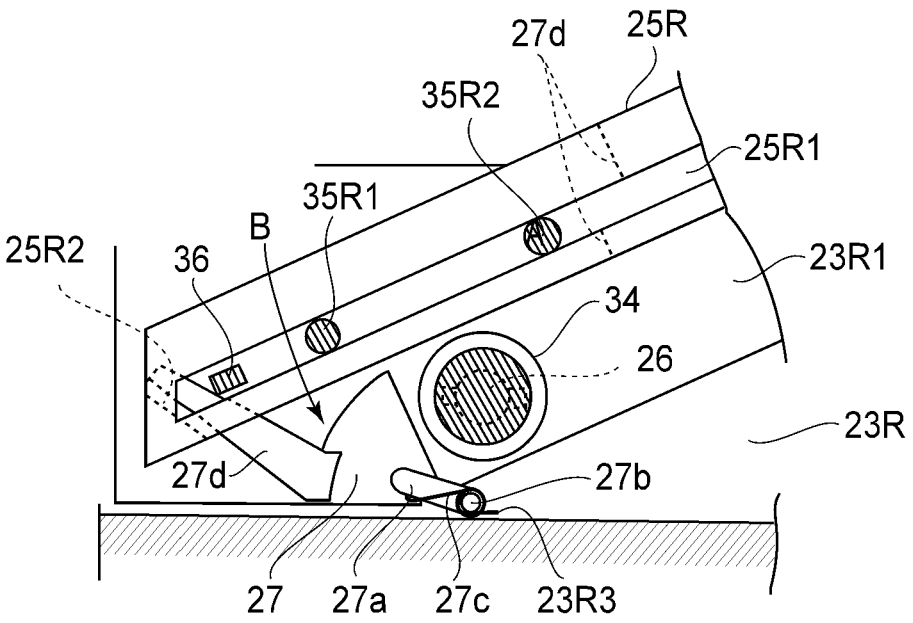

Parts (a) and (b) of FIG. 6A are schematic views for illustrating an operation of the cover, and (a) and (b) of FIG. 6B are schematic views for illustrating the operation of the cover.

Figure 7:
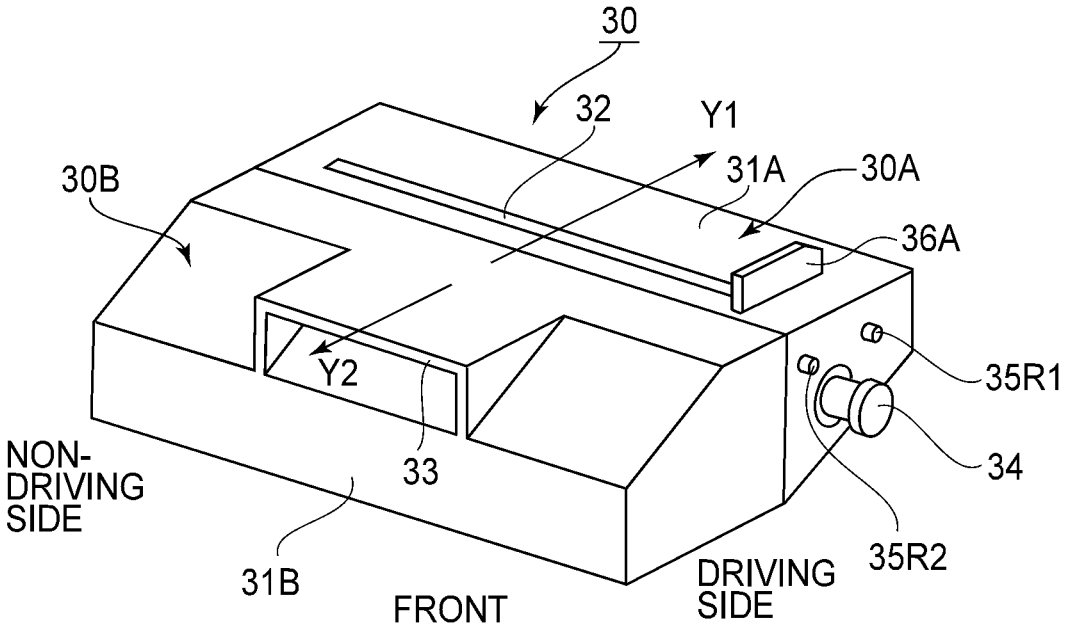

FIG. 7 is a perspective view of an outer appearance of a cartridge as seen from a longitudinal end side (driving side) in Embodiment 2.

Figure 8:
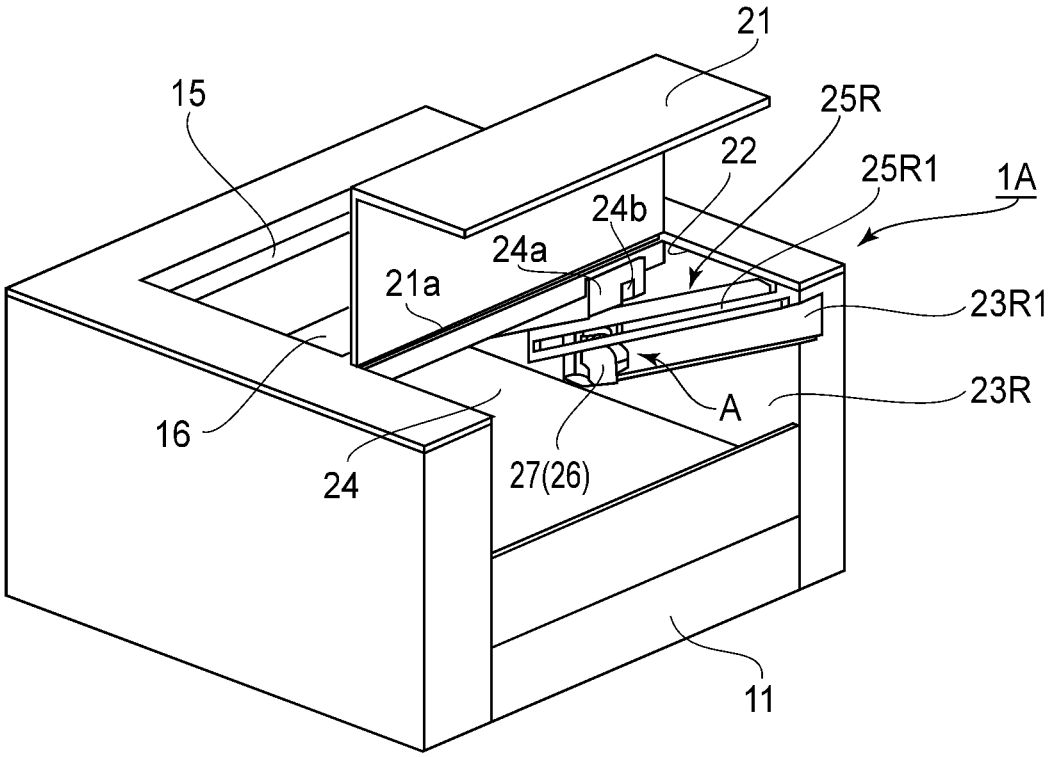

FIG. 8 is a perspective view showing a state of an apparatus main assembly in a condition (state) in which the cartridge is not mounted to the apparatus main assembly and showing an inner surface of a right side plate in the driving side of the apparatus main assembly.

Figure 9:
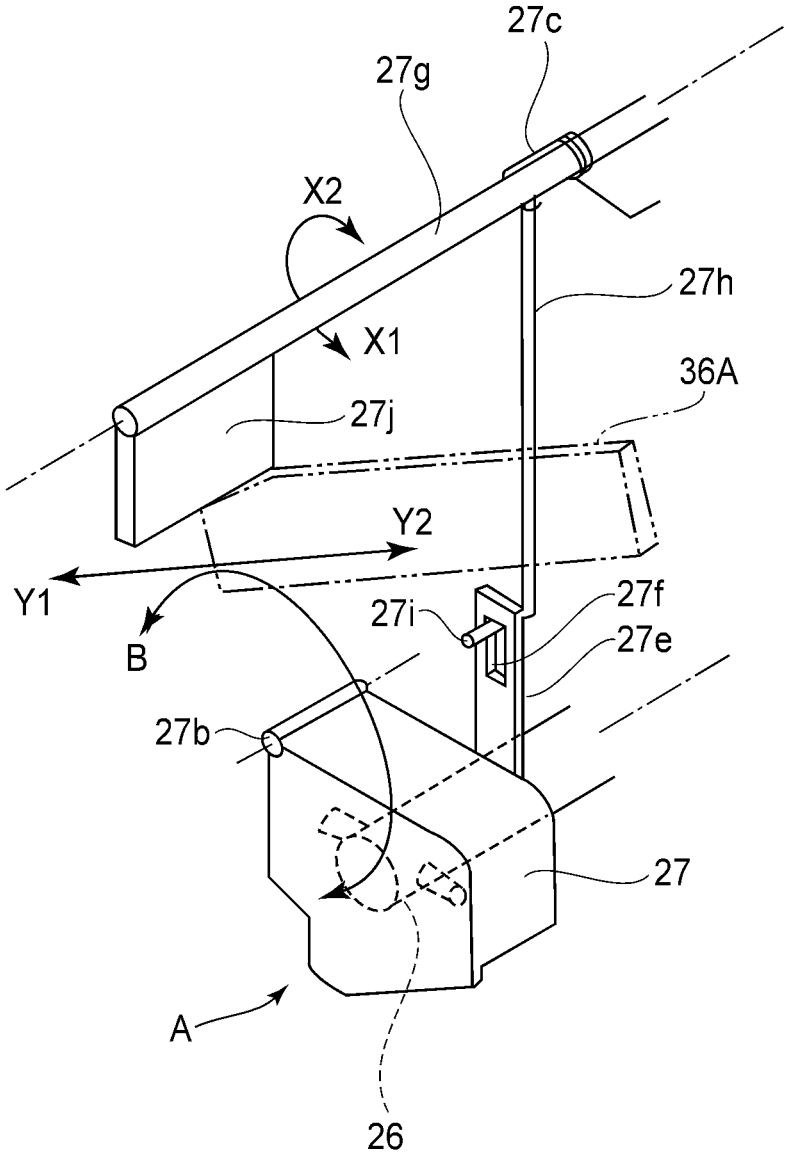

FIG. 9 is a perspective view of a link mechanism for openably moving a cover as a protecting member.

Figure 10:
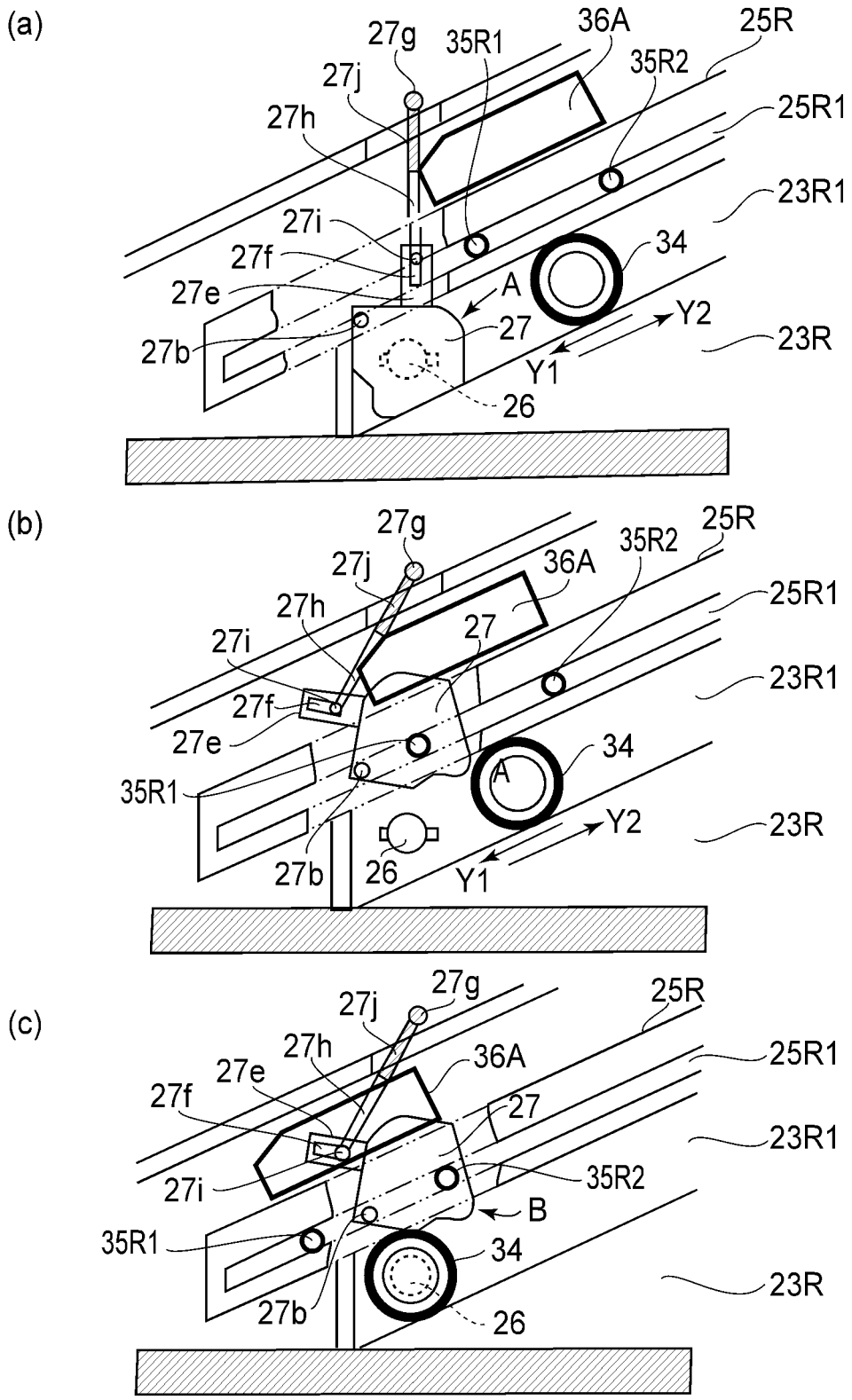

Parts (a), (b) and (c) of FIG. 10 are schematic views for illustrating an operation of the cover.

Figure 11:
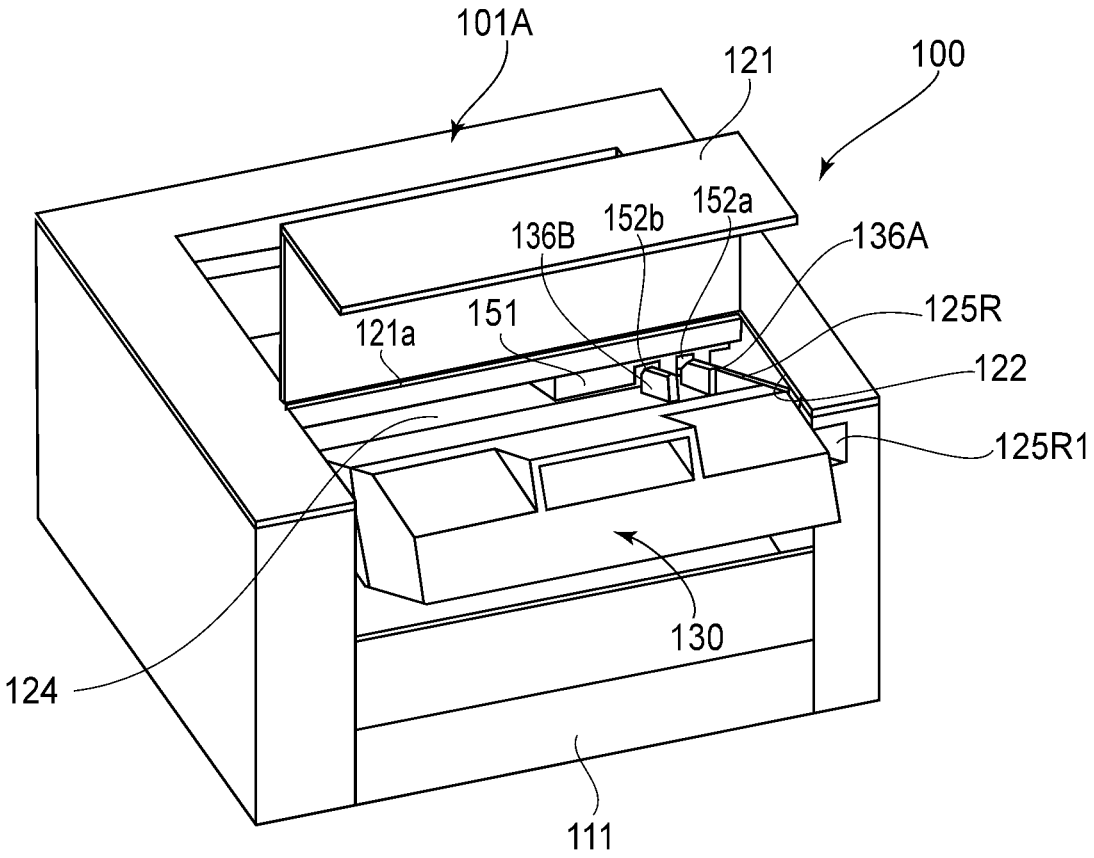

FIG. 11 is a perspective view of an image forming apparatus into which a cartridge is inserted in Embodiment 3.

Figure 12:
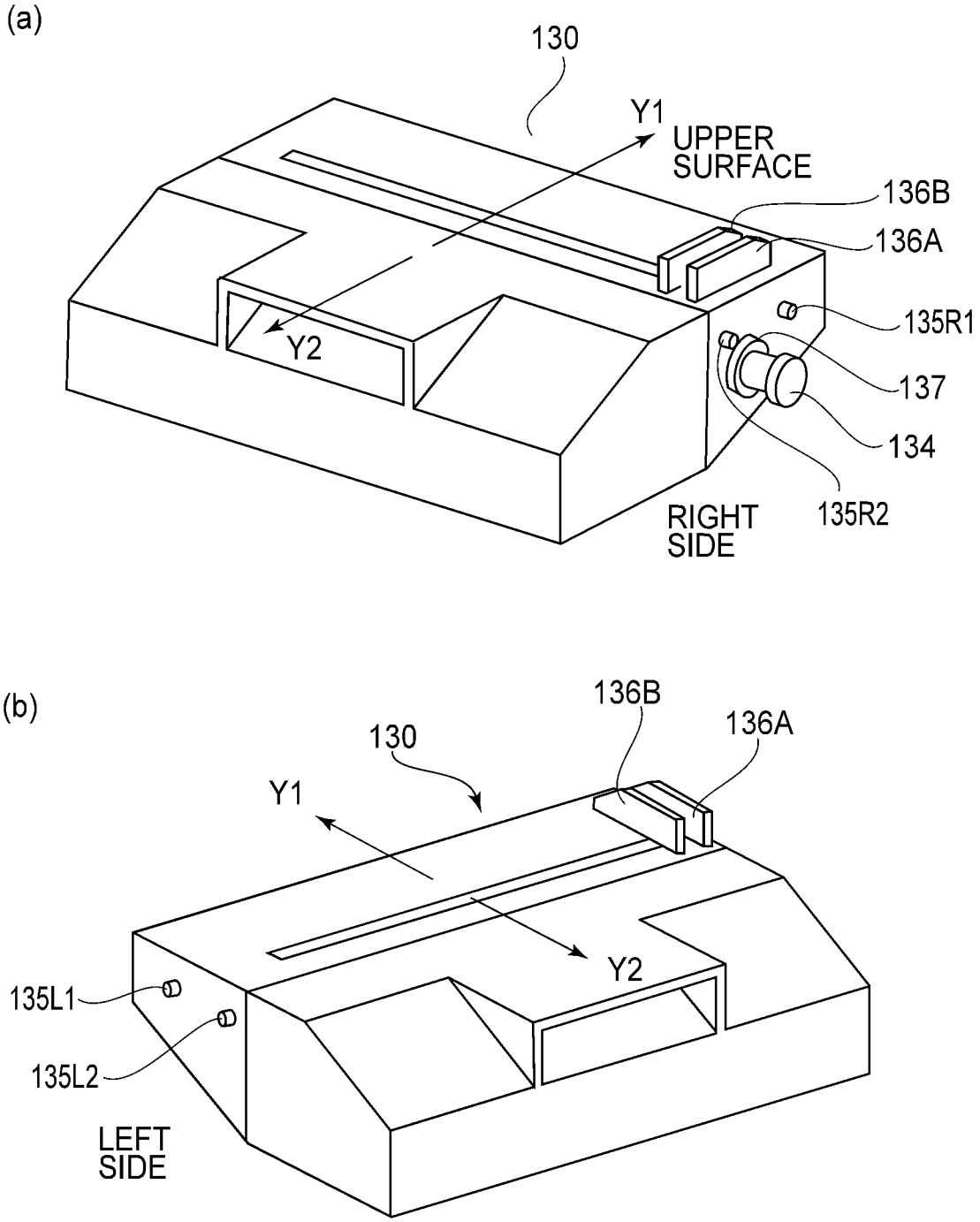

Parts (a) and (b) of FIG. 12 are perspective views of an outer appearance of the cartridge in Embodiment 3.

Figure 13:
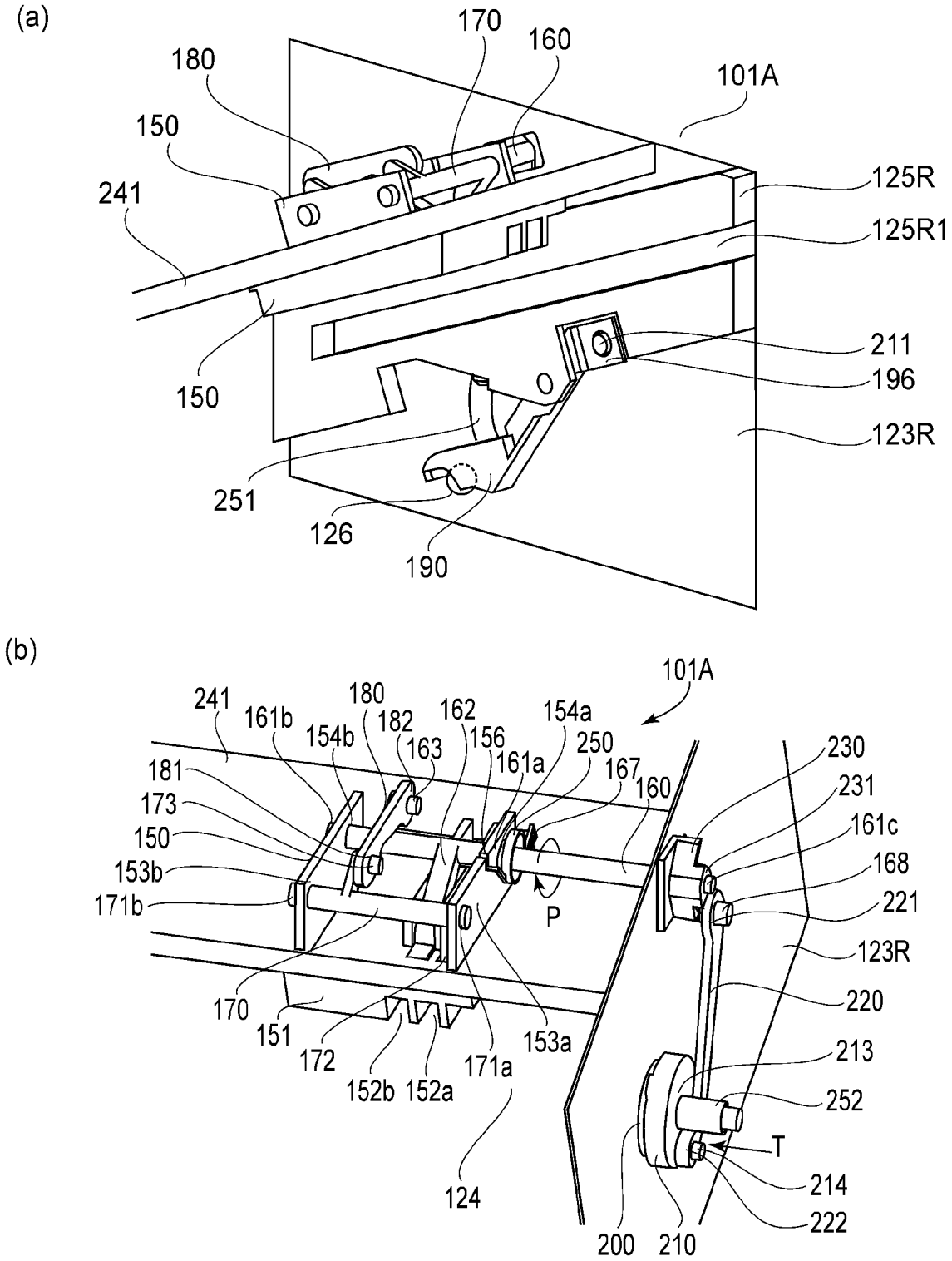

Parts (a) and (b) of FIG. 13 are schematic perspective views of a constitution for protecting a drive output coupling in Embodiment 3.

Figure 14:
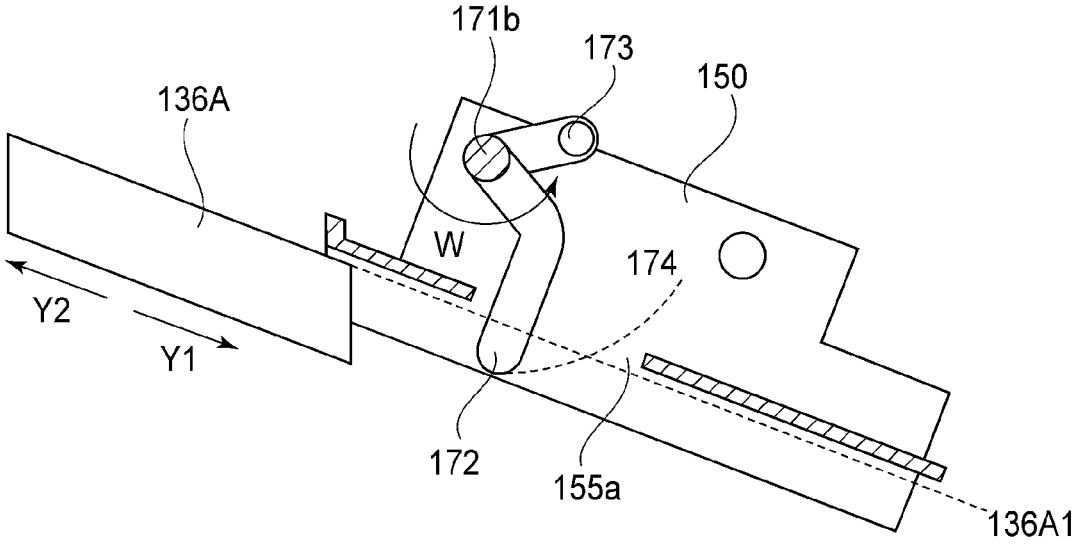
Figure 14:
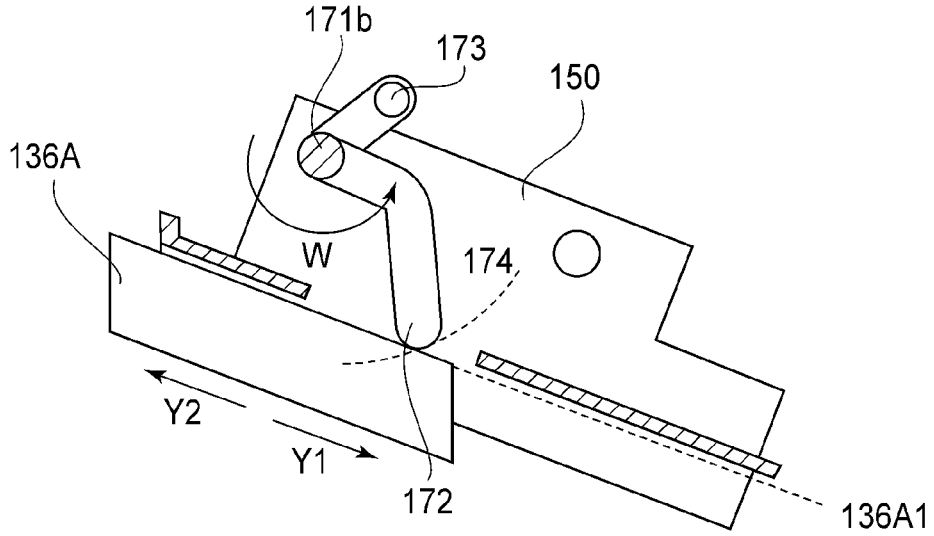

Parts (a) and (b) of FIG. 14 are schematic sectional views showing an operation of a sub-lever in Embodiment 3.

Figure 15:
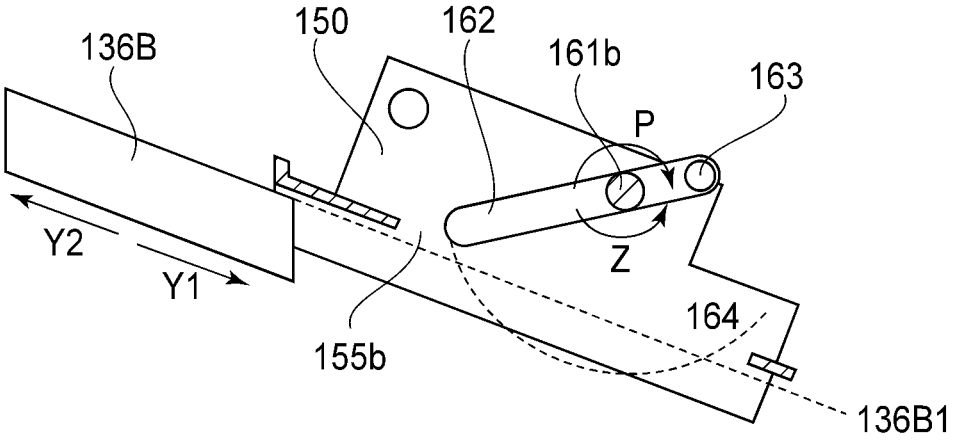
Figure 15:
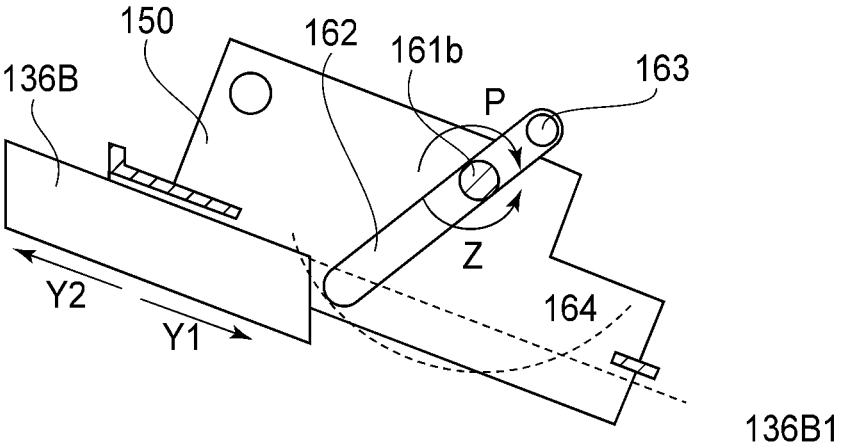
Figure 15:
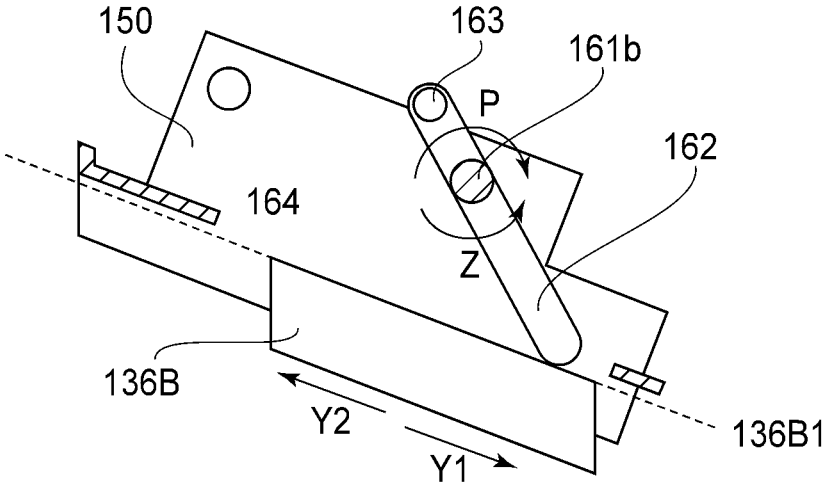

Parts (a), (b) and (c) of FIG. 15 are schematic sectional views showing an operation of a main lever in Embodiment 3.

Figure 16:
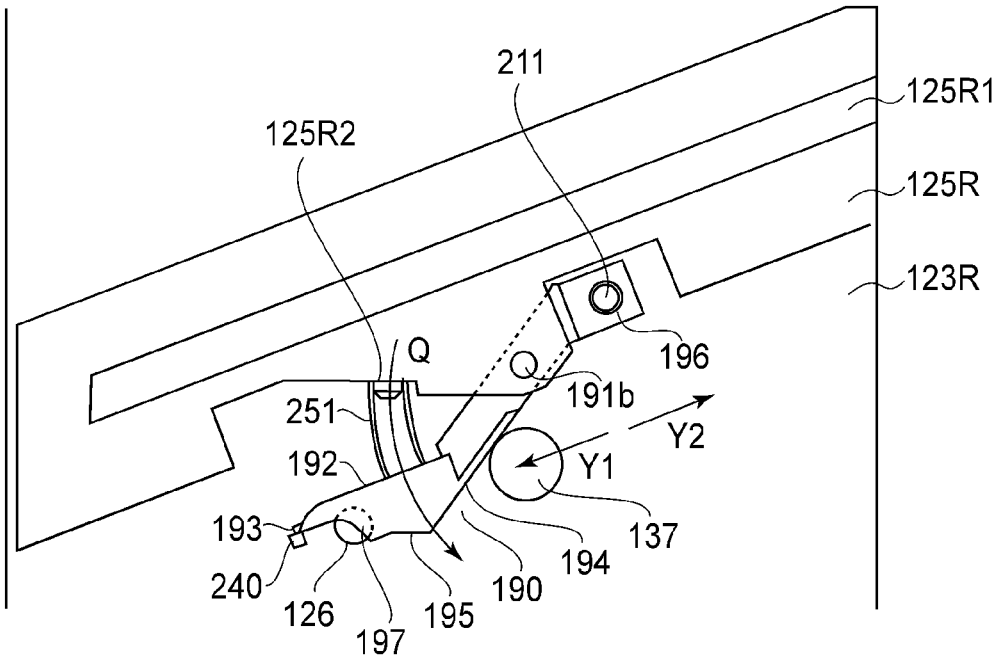
Figure 16:
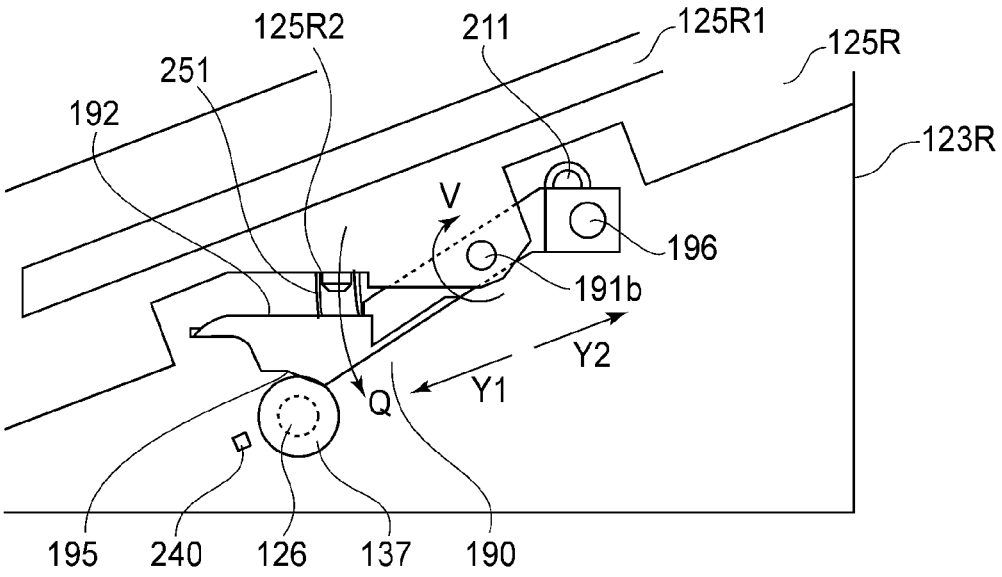

Parts (a) and (b) of FIG. 16 are schematic views for illustrating an operation of a cartridge lever in Embodiment 3.

Figure 17:
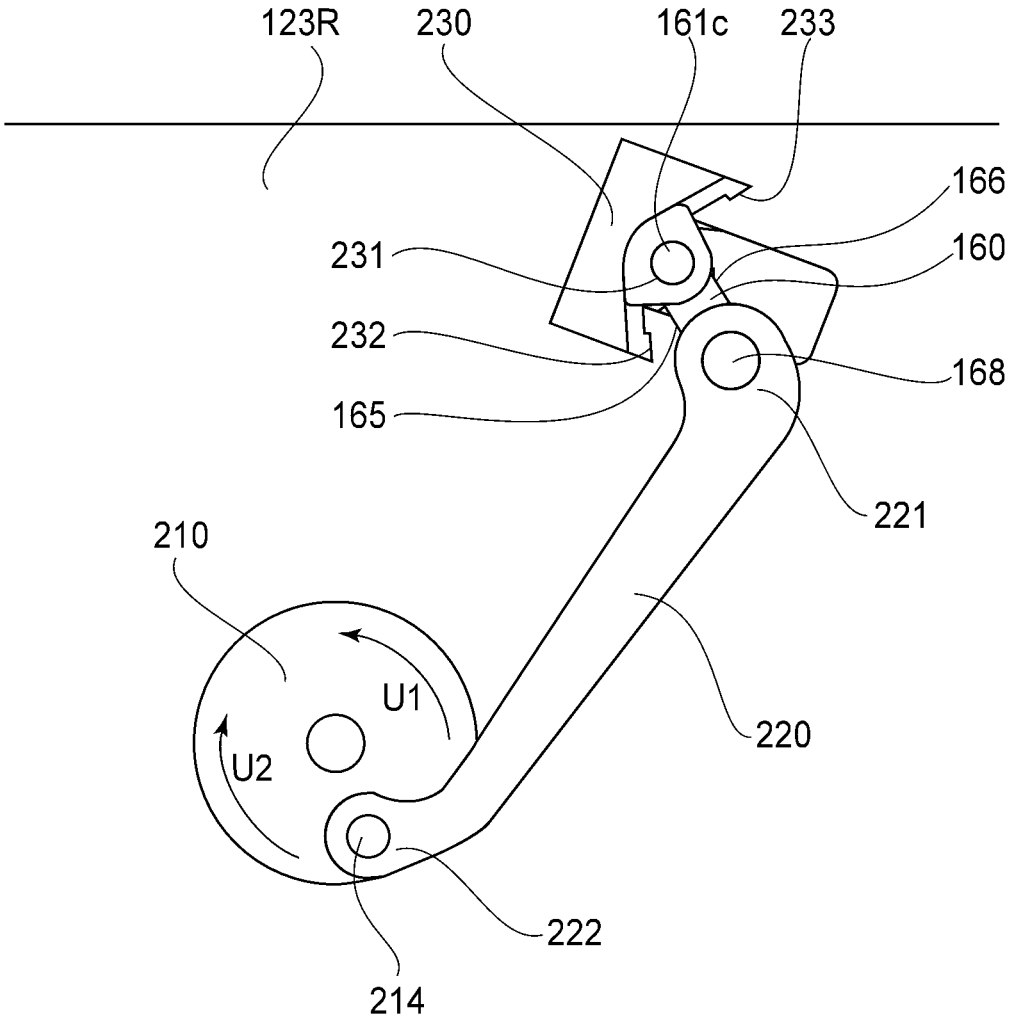

FIG. 17 is a schematic right side view of a constitution for protecting the drive output coupling in Embodiment 3.

Figure 18:
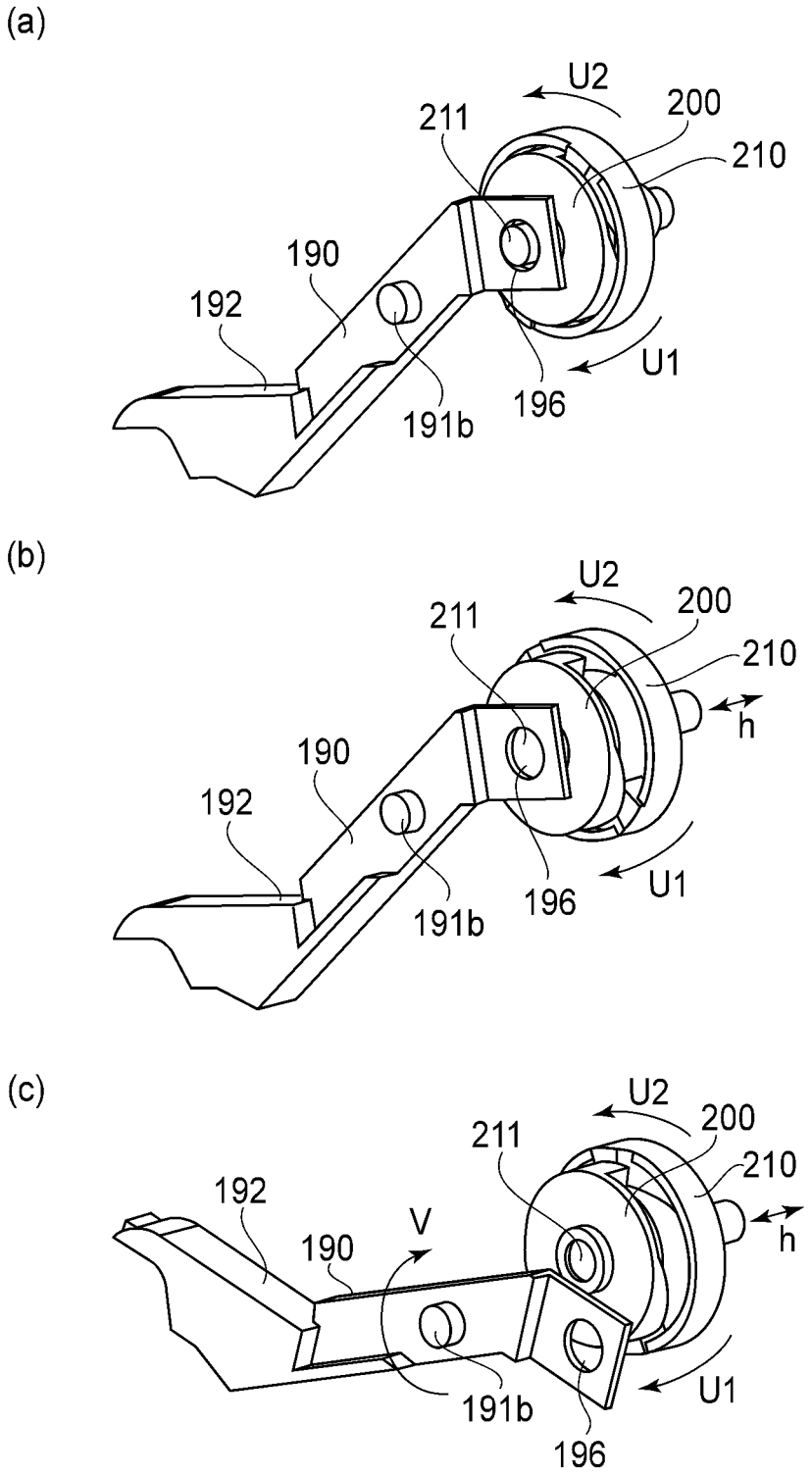

Parts (a), (b) and (c) of FIG. 18 are schematic views showing a locking operation of the cartridge lever in Embodiment 3.

Figure 19:
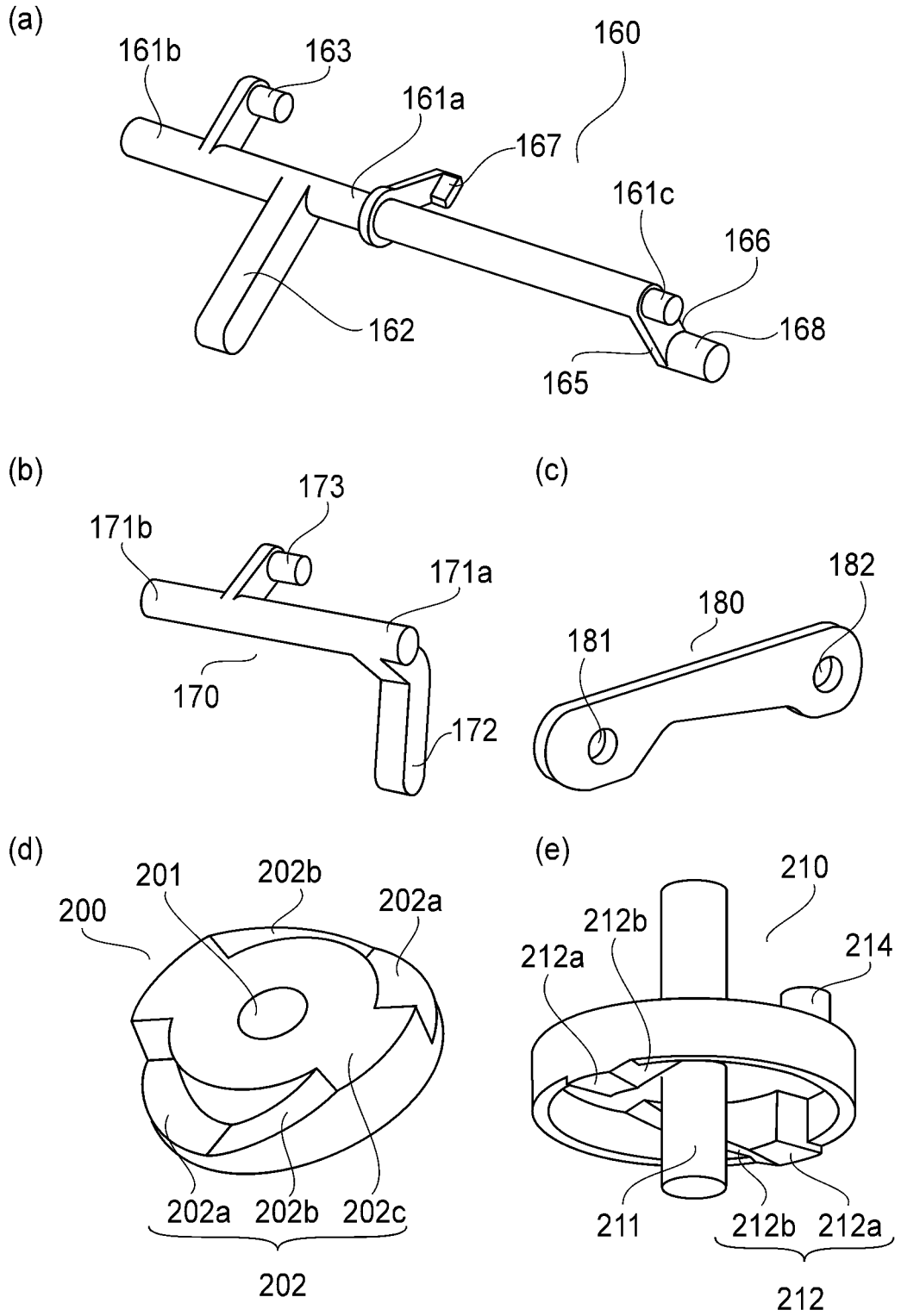

Parts (a) to (e) of FIG. 19 are schematic views each showing a single part in Embodiment 3.

Figure 20:
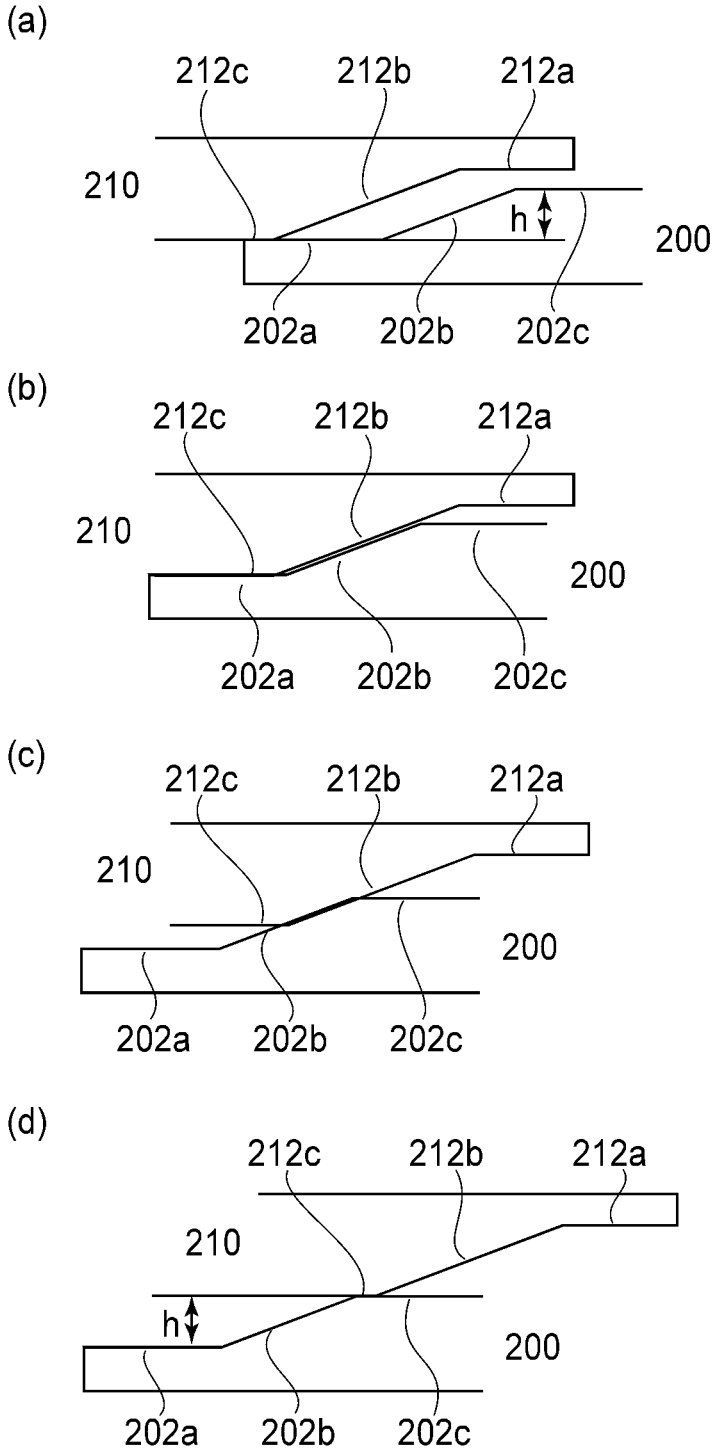

Parts (a) to (d) of FIG. 20 are schematic views each showing a phase between a base cam and a slide cam in Embodiment 3.

DESCRIPTION OF THE EMBODIMENTS

Embodiments of the present invention will be specifically described below with reference to the drawings.

Embodiment 1

General Structure of Image Forming Apparatus

Figure 1:
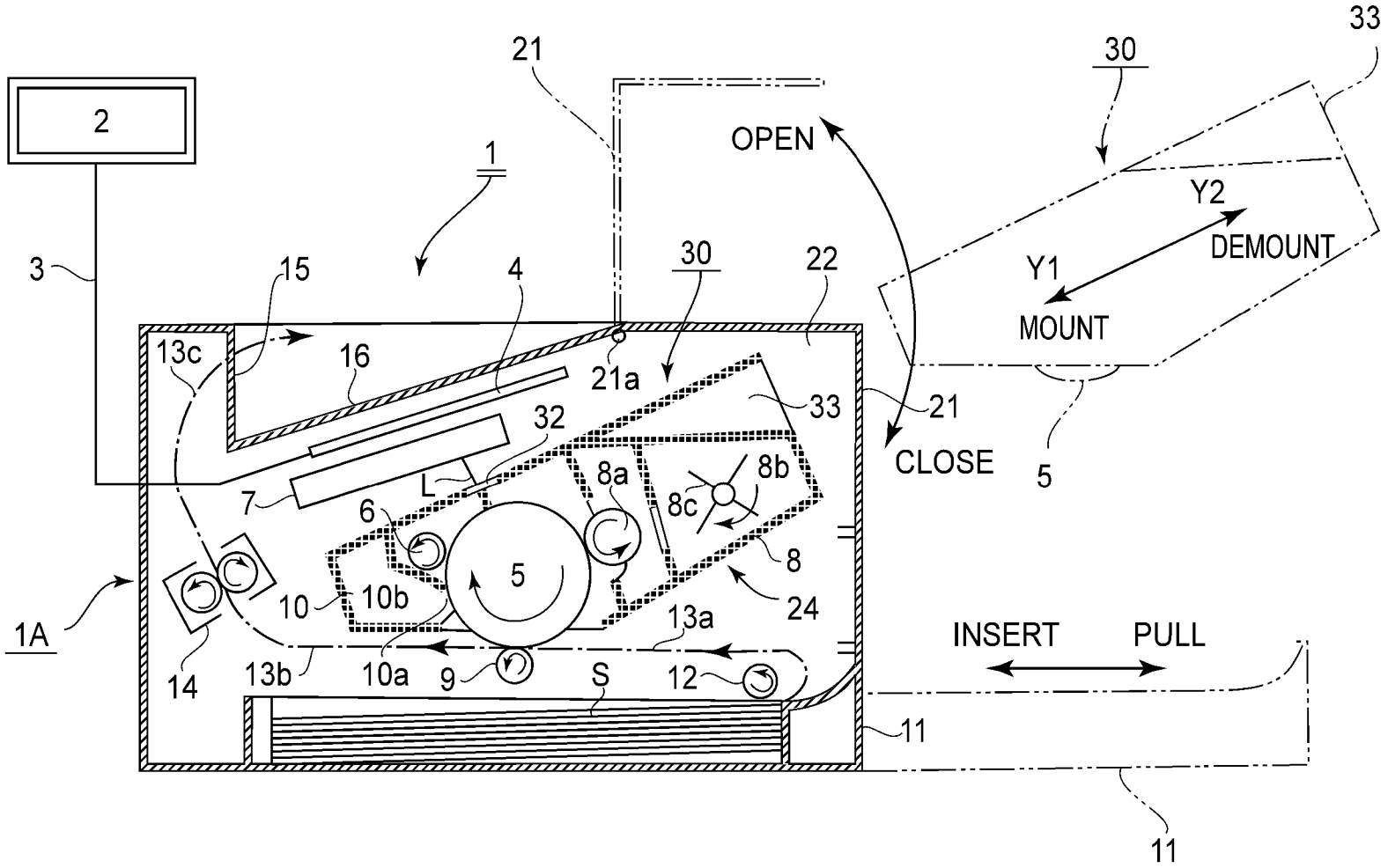
FIG. 1 is a schematic illustration of an image forming apparatus in Embodiment 1.

FIG. 1 is a schematic illustration of an image forming apparatus in this embodiment. The image forming apparatus 1 is a laser beam printer (electrophotographic image forming apparatus) of a cartridge type using an electrophotographic image forming process. That is, the image forming apparatus 1 forms an image on a sheet-like recording material S as a recording medium on the basis of an electrical image signal inputted from an external host device 2, such as a personal computer or an image reader, into a controller (contact means) 4 via an interface 3.

With respect to the image forming apparatus 1 in this embodiment, a front surface (side) is a side where an openable door 21 is provided. Left and right are those when the image forming apparatus 1 is viewed from the front surface (side). An apparatus main assembly 1A refers to an image forming apparatus constituent portion from which a cartridge 30 is removed. Inside the apparatus main assembly 1A, a cartridge mounting portion 24 to which the cartridge 30 contributing to an image forming process for forming the image is detachably mountable is provided.

In this embodiment, the cartridge 30 is a process cartridge of a so-called integral type. With respect to the cartridge 30, an electrophotographic member 5 as an image bearing member on which a latent image is to be formed, and as an image forming process means actable on the electrophotographic photosensitive member, a charging means 6, a developing means 8 and a cleaning means 10 are assembled with a cartridge frame in a predetermined arrangement relationship.

The electrophotographic member 5 is of a drum type, and is rotatably shaft-supported by and assembled with the cartridge frame. Hereinafter, the electrophotographic photosensitive member 5 is referred to as a drum 5. The charging means 6 is a means for electrically charging the surface of the drum 5 uniformly to a predetermined potential and a predetermined polarity. In this embodiment, the charging means 6 is a charging roller, and is arranged in press contact and parallel with the drum 5, and is rotatably shaft-supported by the cartridge frame and is assembled with the cartridge frame.

The developing means 8 is a means for developing, with the developer (toner), the electrostatic latent image formed on the drum 5 and is assembled with the cartridge frame. The developing means 8 includes a developing roller 8*a* as a developer carrying member for carrying the developer and for supplying the developer to the drum 5, a developer accommodating container 8*b* in which the developer is accommodated, a rotatable paddle 8*c* for stirring the developer in the developer accommodating container 8*b* and for feeding the developer to the developing roller 8*a*, and the like. The developing roller 8*a* is provided opposed to and in parallel to the drum 5 in a contact or non-contact state, and is rotatably supported by said assembled with the cartridge frame.

The cleaning means 10 is a means for removing a transfer residual developer from the surface of the drum 5 and is assembled with the cartridge frame. The cleaning means 10 is a blade cleaning means and includes an elastic blade 10*a* provided in press-contact with the drum 5, a residual developer container 10*b*, and the like.

The cartridge 30 is, when the cartridge 30 is mounted to the cartridge mounting portion 24 of the apparatus main assembly 1A, in a state in which the cartridge 30 is mechanically and electrically connected with a drive transmitting member (driving portion) and an electric power supplying portion in the apparatus main assembly 1A side to be capable of performing an image forming operation. Further, inside the apparatus main assembly 1A, a transfer roller 9 for forming a transfer nip in contact with a lower surface of the drum 5 of the cartridge 30 in a state in which the cartridge 30 is mounted to the cartridge mounting portion in a predetermined manner is provided.

Above the cartridge mounting portion 24, a laser scanner unit 7 as an exposure means is provided. This unit 7 outputs laser light L modulated corresponding to an electrical image signal inputted from the external host device 2 to the controller 4. The laser light L enters the cartridge 30 through an exposure window portion 32 of the cartridge 30, so that the surface of the drum 5 is subjected to main scanning exposure.

Below the cartridge mounting portion 24, a sheet feeding tray 11 in which sheets of the recording material P are stacked and accommodated is provided. The sheet feeding tray 11 is subjected to an operation for being inserted into and pulled out from the apparatus main assembly 1A from the front (surface) side of the apparatus main assembly 1A (front loading type). Inside of the apparatus main assembly 1A in the front side, a sheet feeding roller 12 is provided at an upper portion of the sheet feeding tray 11. Further, inside the apparatus main assembly 1A in the rear (surface) side, a fixing device 14 is provided.

The image forming operation is as follows. On the basis of an image formation start signal, the drum 5 is rotationally driven at a predetermined control speed in the clockwise direction indicated by an arrow. The laser scanner unit 7 is also driven. In synchronization with the driving of the unit 7, the charging roller 6 uniformly electrically charges the surface of the drum 5 to the predetermined polarity and the predetermined potential. The charging roller 6 is rotated by rotation of the drum 5.

The unit 7 scans (exposes) the uniformly charged surface of the drum 5 with the laser light L modulated correspondingly to the electrical image signal with respect to a main scan direction. As a result, an electrostatic latent image corresponding to a scanning exposure pattern is formed on the surface of the drum 5. The electrostatic latent image is developed by the developing roller 8*a*, rotated at a predetermined speed in the counterclockwise direction indicated by an arrow, into a developer image (toner image).

On the other hand, at predetermined control timing, the sheet feeding roller 12 is driven, so that the recording material S corresponding to one sheet in the sheet feeding tray 11 is separated and fed. The recording material S passes through a conveying path 13*a* to be introduced into the transfer nip at predetermined control timing. As a result, the developer image formed on the surface of the drum 5 is successively transferred onto the surface of the recording material S nipped and conveyed through the transfer nip. The recording material S passed through the transfer nip is separated from the surface of the drum 5 and then passes through a conveying path 13*b* to be introduced into the fixing device 14. The surface of the drum 5 from which the recording material S is separated is cleaned by removing the transfer residual developer therefrom by the cleaning means 10, thus being repetitively subjected to the image formation.

The recording material S introduced into the fixing device 14 is heated and pressed in a fixing nip. As a result, the developer image is fixed as a fixed image on the surface of the recording material S. The recording material S coming out of the fixing device 14 passes through a conveying path 13*c* to be discharged as an image-formed product onto a discharge tray portion 16, at an upper surface of the image forming apparatus, through a discharging opening 15.

(Cartridge)

Part (a) of FIG. 2 is a perspective view of an outer appearance of the cartridge 30 as seen from a longitudinal end side (driving side) in this embodiment, and (b) of FIG. 2 is a perspective view of the outer appearance of the cartridge 30 as seen from the other longitudinal end side (non-driving side) in this embodiment.

The cartridge 30 is constituted by connecting a drum unit 30A and a developing device unit 30B. With respect to the drum unit 30A, inside a cleaning frame (cartridge frame) 31A, members including the drum 5, the charging roller 6 and the cleaning means 10 are assembled in a predetermined arrangement relationship. With respect to the developing device unit 30B, inside a developing (device) frame (cartridge frame) 31B, the developing means 8 is assembled. The drum unit 30A and the developing device unit 30B are connected with each other to constitute the cartridge 30.

The cartridge 30 is an elongated assembly extending in, as a longitudinal direction, a rotational axis direction of the drum 5, and a widthwise (short) direction perpendicular to the longitudinal direction is a direction in which the cartridge 30 is demounted from and mounted to the apparatus main assembly 1A. An arrow Y1 shows a mounting direction, and an arrow Y2 shows a demounting direction.

With respected to the cartridge 30, a front surface (side) is a surface (side) of the cartridge 30 as seen from the mounting direction Y1 to the apparatus main assembly 1A, and a rear surface (side) is a surface (side) opposite from the front surface (side) as seen from the front surface (side). Left and right are those when the cartridge 30 is viewed from the front side. With respect to the cartridge 30 in this embodiment, a side where the developing device unit 30B is provided is the front side, and a side where the drum unit 30A is provided is the rear side. A longitudinal end side of the cartridge 30 is a driving side, and the other longitudinal end side of the cartridge 30 is a non-driving side. In this embodiment, a right end portion side of the cartridge 30 is the driving side, and a left end portion side of the cartridge 30 is the non-driving side.

At an upper surface of the cleaning frame 31A, the exposure window portion 32 is formed along the longitudinal direction. At a longitudinal central portion on the upper surface of the developing frame 31B, a grip (handle) portion 33 is formed. The cartridge 30 is handled by gripping the grip portion 33.

At a right side surface portion as the driving side of the cleaning frame 31A, a drive input coupling 34 as a drive-transmitted member (drive connecting member) is provided. By transmitting a driving force to the coupling 34, the drum 5, the developing roller 8*a* and the paddle 8*c* are rotationally driven at a predetermined speed in a predetermined direction via a drive transmission member (not shown) provided in the cartridge 30.

At right and left side surface portions of the cleaning frame 31A, as guided members for the cartridge 30, first mounting and demounting guide bosses 35R1 and 35L1 are provided, respectively, and second mounting and demounting guide bosses 35R2 and 35L2 are provided, respectively. The first and second mounting and demounting guide bosses 35R1 and 35L2 and the first and second mounting and demounting guide bosses 35L1 and 35L2 are provided in a bilaterally symmetrical manner, respectively. The first mounting and demounting guide bosses 35R1 and 35R2 and the second mounting and demounting guide bosses 35L1 and 35L2 are provided with a predetermined spacing, in a downstream side and an upstream of the direction Y1 in which the cartridge 30 is mounted to the apparatus main assembly 1A.

Further, at the right side surface portion of the cleaning frame 31A, a contact boss 35 as a contact position contactable to a cover 27 ((a) of FIG. 3) as a protecting member, described later, provided in the apparatus main assembly 1A side is provided. The contact boss 36 is provided in a position downstream of the first mounting and demounting guide boss 35R1 with respect to the direction Y1 in which the cartridge 30 is mounted to the apparatus main assembly 1A.

(Mounting and Demounting of Cartridge with Respect to Apparatus Main Assembly)

Mounting of the cartridge 30 to the apparatus main assembly 1A will be described. Parts (a) and (b) of FIG. 3 are perspective views each showing an open state of an openable door 21 in a condition (state) in which the cartridge is not mounted to the apparatus main assembly 1A, wherein (a) is a perspective view showing an inner surface of a right side plate 23R in a driving side of the apparatus main assembly, and (b) is a perspective view showing an inner surface of a left side plate 23L in a non-driving side of the apparatus main assembly 1A.

In this embodiment, as an outer casing (cover) of the apparatus main assembly 1A, a substantially front side portion of the upper surface and a substantially upper-half portion of the front surface are integrally provided to constitute the openable door 21 capable of being rotated about a hinge portion 21*a* relative to the apparatus main assembly 1A to open and close an opening of the apparatus main assembly 1A.

The mounting of the cartridge 30 to the apparatus main assembly 1A is carried out by opening the openable door 21 upward about the hinge portion 21*a* as indicated by a chain double-dashed line in FIG. 1. By opening the openable door 21, the substantially front side portion of the upper surface and the substantially upper-half portion of the front surface of the apparatus main assembly 1A are largely opened as an opening 22. Further, in a state in which the cartridge 30 is not mounted, the cartridge mounting portion 24 in the apparatus main assembly is seen.

At inner surfaces of the right and left side plates 23R and 23L of the apparatus main assembly 1A, cartridge guiding members 25R and 25L for mounting the cartridge 30 are provided, respectively, in a bilaterally symmetrical manner. These guiding members 25R and 25L are provided with guide grooves 25R1 and 25L1, respectively, in a bilaterally symmetrical manner so that each of the guide grooves 25R1 and 25L1 is inclined toward the front side as seen in the mounting direction of the cartridge 30.

Further, at the inner surface of the right side plate 23R of the apparatus main assembly 1, a drive input coupling guide groove 23R1 is provided below and in parallel to the guide groove 25R1. In a predetermined position in a downstream side of the guide groove 23R1 with respect to the cartridge mounting direction, a drive output coupling 26 (FIG. 4) as the drive transmission member in the apparatus main assembly 1A side is provided.

Figure 6B:
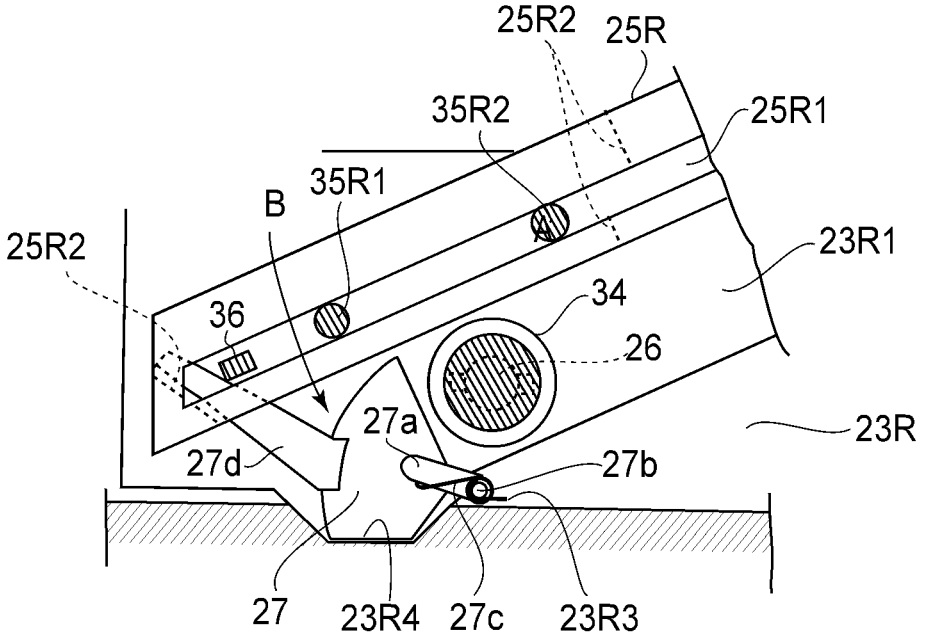

The coupling 26 is covered, relative to the cartridge mounting portion 24 by movement of a movable cover 27, as the protecting member, to a protecting position A. Part (a) of FIG. 3 and (a) of FIG. 6 show a state in which the cover 27 is moved to the protecting position A to cover and protect the coupling 26.

The mounting of the cartridge 30 to the apparatus main assembly 1A is performed as follows. As shown in FIG. 3, the opening 22 is largely opened by opening the openable door 21 of the apparatus main assembly 1A. A user (operator) holds the cartridge 30 by gripping the grip portion 33, and then inserts the cartridge 30 into the cartridge mounting portion 24 through the opening 22 with the drum unit 30A frontward.

Further, the first mounting and demounting guide bosses 35R1 and 35L1 in the right and left sides, respectively, of the cartridge 30 are engaged with the guide grooves 25R1 and 25L1 of the right and left cartridge guiding members 25R and 25L, respectively, provided in the apparatus main assembly 1A side. Further, also the second mounting and demounting guide bosses 35R2 and 35L2 are engaged with the guide grooves 25R1 and 25L1, respectively. Then, the first and second mounting and demounting guide bosses 35R1, 35L1, 35R2 and 35L2 are moved along the guide grooves 25R1 and 25L1, respectively, so that the cartridge 30 is inserted into the cartridge mounting portion 24 of the apparatus main assembly 1A.

In that case, the mounting and demounting guide bosses 35R1, 35L1, 35R2 and 35L2 are limited by the guide grooves 25R1 and 25L1, so that an insertion attitude of the cartridge 30 is maintained. Further, the drive input coupling 34 is engaged into the guide groove 23R1 and is moved in the cartridge mounting direction Y1 along the guide groove 23R1.

During the mounting of the cartridge 30 to the cartridge mounting portion 24, the contact boss 36 of the cartridge 30 contacts a contacted portion 37*d* (FIGS. 5 and 6A), described later, of the cover 27 in the apparatus main assembly 1A side. Then, the cartridge 30 is further continuously inserted into the mounting portion 24, so that the cover 27 is moved and retracted by the boss 36 from the protecting position A ((a) of FIG. 6A) to an open position B (FIG. 6B).

When the cover 27 is sufficiently moved from the protecting position A to the open position B, further movement of the cover 27 is stopped. By the stop of the movement of the cover 27, also the cartridge 30 is prevented from moving further. In this state, the drive output coupling 26 is in a sufficiently exposed state, so that the drive input coupling 34 in the cartridge 30 side is placed in a predetermined opposing state to the drive output coupling 26 (FIG. 6B).

Then, the operator closes the openable door 21 which is open. By an operation of an interrelating mechanism (not shown) interrelated with this closing operation of the openable door 21, an urging means (not shown) performs an urging operation to urge the cartridge 30 against a positioning portion (not shown) in the apparatus main assembly 1A side, so that the cartridge 30 is fixed and held in a positioned state in a predetermined mounting position. By this fixing and holding, the drum 5 and the transfer roller 9 are placed in a contact state in a predetermined manner.

Further, the drive output coupling 26 in the apparatus main assembly 1A side performs an engaging operation with the drive input coupling 34 in the cartridge 30 side. Further, an electrical contact portion (not shown) for outputting biases (charging bias and developing bias) in the apparatus main assembly 1A side is in an electrically connected state with an electrical contact portion (not shown) in the cartridge 30 side. Thus, the cartridge 30 is in an image formable state.

Demounting of the cartridge 30 mounted to the apparatus main assembly 1A is made by opening the openable door 21. When the openable door 21 is opened, the urging means performs an urging elimination operation by the operation of the interrelating mechanism interrelated with the opening operation of the openable door 21, so that urging fixing of the cartridge 30 with respect to the positioning portion in the apparatus main assembly 1A side is released (eliminated). Further, the engagement of the drive output coupling 26 in the apparatus main assembly 1A side with the drive input coupling 34 in the cartridge 30 side is released (eliminated). As a result, the cartridge 30 is placed in a demountable state.

Then, the operator grips the grip portion 33 of the cartridge 30 open to the opening 22 and then moves the cartridge 30 from the cartridge mounting portion 24 to an outside of the apparatus main assembly 1A along the cartridge guiding members 25R and 25L in the demounting direction Y2 opposite to the mounting direction Y1. As a result, the mounting and demounting guide bosses 35R1, 35L1, 35R2 and 35L2 and the drive input coupling 34 in the cartridge 30 side are disconnected and demounted from the guide grooves 25R1, 25L1 and 23R1 in the apparatus main assembly 1A side, so that the cartridge 30 is taken out from the apparatus main assembly 1A.

(Protecting Member and Movement Thereof)

The cover 27 as the protecting member is, in the case where the cartridge 30 is not mounted to the cartridge mounting portion 24, movable to the protecting position A where exposure of the drive output coupling 26 to the cartridge mounting portion 24 is prevented. Further, the cover 27 is, in the case where the cartridge 30 is mounted to the cartridge mounting portion 24, movable to the open position B (FIG. 6B) by being retracted from the protecting position A. The open position B is a position where the drive output coupling 26 is exposed to the cartridge mounting portion 24 and thus is permitted to engage with the drive input coupling 34. That is, the cover 27 is movable between the protecting position A and the open position B.

Part (a) of FIG. 5 is a perspective view of an outer appearance of the cover 27 as seen from an outside, and (b) of FIG. 5 is a perspective view of the outer appearance of the cover 27 as seen from a side. The cover 27 is a member having a box-like shape such that the cover 27 can surround and cover an outer peripheral portion of the drive output coupling 26, in the guide groove 23R1, except for an opposing surface to the drive input coupling 34 and a lower surface thereof.

At a lower portion of the cover 27 in an outer surface side, a downward first arm portion 27*a* is provided. At a lower portion of the arm portion 27*a*, a shaft portion 27*b* is provided and projected toward the right side plate 23R. Further, to the shaft portion 27*b*, a torsion spring 27*c* as an urging member is mounted by locking an end portion of thereof on the arm portion 27*a*. Further, at an upper portion of the cover 27 in the front side, an upward second arm portion 27*d* as a contacted portion (portion-to-be-contacted) is provided.

The shaft portion 27*b* of the cover 27 is inserted into and held by a shaft hole 23R2 (FIG. 4) provided in an inner surface of the right side plate 23R. The other end portion of the torsion spring 27 is inserted into and locked in a locking hole 23R3 provided in the inner surface of the right side plate 23R. The second arm portion 27*d* is inserted into and positioned in a slit hole 25R2 provided between the right side plate 23R and the guiding member 25R. In this state, the cover 27 is positioned in the guide groove 23R1, and is movable between the protecting position A and the open position B by being rotated about the shaft portion 27*b*.

The cover 27 is always rotationally urged about the shaft portion 27*b* in a direction of movement of the protecting position A by an urging force of the torsion spring 27, and is moved to the protecting position by the urging force of the torsion spring 27 during a free state. In (a) of FIG. 6A, the protecting position A of the cover 27 is a position of a state in which the cover 27 is rotated about the shaft portion 27*b* in the clockwise direction and is abutted against and received by the bottom (surface) of the guide groove 23R1.

Accordingly, in a state (uninserted state) in which the cartridge 30 is not mounted to the cartridge mounting portion 24 of the apparatus main assembly 1A, the cover 27 is closed, so that the drive output coupling 26 is covered relative to the cartridge mounting portion 24 ((a) of FIG. 3). Further, in this state, the upward second arm portion 27*d* as the contacted portion is positioned and covered inside the guiding member 25R so that the operator cannot push and open the cover 27 with the hand.

With reference to schematic views of FIGS. 6A and 6B, a moving operation of the cover 27 from the protecting position A to the open position B with movement of the cartridge 30 will be described.

As described above, by opening the openable door 21 of the apparatus main assembly 1A to largely open the opening 22, the first and second mounting and demounting guide bosses 35R1, 35L1, 35R2 and 35L2 of the cartridge 30 are engaged with the guide grooves 25R1 and 25L1 of the guiding members 25R and 25L, respectively. Then, the guide bosses 35R1, 35L1, 35R2 and 35L2 are moved along the guide grooves 25R1 and 25L1 to insert the cartridge 30 into the cartridge mounting portion 24 of the apparatus main assembly 1A. The drive input coupling 34 is engaged with the guide groove 23R1 and then is moved in the cartridge mounting direction Y along the guide groove 23R1.

Part (a) of FIG. 6A shows a position state of the first and second mounting and demounting guide bosses 35R1 and 35R2, the contact boss 36, the drive input coupling 34 and the cover 27 in the driving side during the insertion of the cartridge 30 into the cartridge mounting portion 24. During this state, the contact boss 36 does not contact the second arm portion 27*d* as the contacted portion of the cover 27. Accordingly, the cover 27 is positioned in the protecting position A< so that the drive output coupling 26 is covered relative to the cartridge mounting portion 24.

By further inserting and moving the cartridge 30, the contact boss 36 contacts the second arm portion 27*d*. With subsequent insertion and movement of the cartridge 30, the second arm portion 27*d* is pressed and moved rearward. For that reason, the cover 27 is rotated about the shaft portion 27*b* in the counterclockwise direction in (b) of FIG. 6A against the urging force of the torsion spring 27*c*. That is, the cover 27 is moved from the protecting position A to the open position B, so that the drive output coupling 26 is gradually exposed.

Then, when the cartridge 30 is sufficiently moved to a predetermined insertion position as shown in (a) of FIG. 6B, the cover 27 enters a receiving recessed-portion 23R4 provided at the bottom in the guide groove 23R1 as shown in (b) of FIG. 6B, thus being received at the bottom of the receiving recessed-portion 23R4. In this state, the cover 27 is prevented from rotating further in the counterclockwise direction. This rotation position of the cover 27 is the open position B.

The cover 27 is rotated to the open position B to be prevented from rotating and moving further, whereby the cartridge 30 is held in the predetermined insertion position in a state in which the contact boss 36 is contacted to and received by the second arm portion 27*d*. In this state, the drive input coupling 34 in the cartridge 30 side is in an opposed state to the exposed drive output coupling 26 in the apparatus main assembly 1A side in a predetermined manner. That is, by mounting the cartridge 30 to the cartridge mounting portion 24 to retract the cover 27 from the protecting position A to the open position B, so that the drive input coupling 34 is placed in an engageable state with the drive output coupling 26.

Then, as described above, by closing the openable door 21, the urging means performs the urging operation by the operation of the interrelating mechanism interrelated with the closing operation of the openable door 21, so that the cartridge 30 is urged against the positioning portion in the apparatus main assembly 1A side to be fixed and held in a positioning state in a predetermined mounting position. Further, the drive output coupling 26 in the apparatus main assembly 1A performs an engaging with the drive input coupling 34 in the cartridge 30 side. Further, the electrical contact portion for outputting the bias in the apparatus main assembly 1A side is in a connected state with the electrical contact portion in the cartridge 30 side. Thus, the cartridge 30 is in an image formable state.

Incidentally, the engagement of the drive input coupling 36 in the side of the cartridge 30 mounted to the cartridge mounting portion 25 with the drive output coupling 26 in the apparatus main assembly 1A side is not limited to a constitution in which the engagement is interrelated with the closing operation of the openable door 21. It is also possible to employ a coupling constitution in which the cartridge 30 is sufficiently moved to the predetermined insertion position of the cartridge 30 into the cartridge mounting portion 24, and at that time, the drive input coupling 34 is in a naturally engaged state with the drive output coupling 26.

In the case where the cartridge 30 is demounted from the apparatus main assembly 1A, the cover 27 positioned in the open position B is returned and moved from the open position B to the protecting position A by the urging force of the torsion spring 27*c* with pulling movement of the cartridge 30 in the demounting direction Y2 opposite to the mounting direction Y1. That is, the contact boss 36 is moved in a direction in which the contact boss 36 is spaced from the second arm portion 27*d*, so that the cover 27 is moved from the open position B to the protecting position A by the urging force of the torsion spring 27*c* in a reverse operation process in the order of FIG. 6B, (b) of FIG. 6A and (a) of FIG. 6A.

Thus, when the cartridge 30 is taken out, the cover 27 is constituted to be placed in a state in which the cover 27 is positioned in the protecting position A and the drive output coupling 26 is covered relative to the cartridge mounting portion 24. Accordingly, during a state in which the cartridge 30 is taken out of the apparatus main assembly 1A, the operator cannot easily touch the drive output coupling 26, so that it becomes possible to protect the drive output coupling 26.

Embodiment 2

FIG. 7 is a perspective view of an outer appearance of the cartridge 30 as seen from a longitudinal end side (driving side) in this embodiment. FIG. 8 is a perspective view showing an open state of the openable door in a condition in which the cartridge is not mounted to the apparatus main assembly in this embodiment, and shows a state in which the inner surface of the right side plate in the driving side of the apparatus main assembly is seen. Constituent members or portions common to Embodiments 1 and 2 are represented by common reference numerals or symbols and will be omitted from redundant description.

The cartridge 30 in this embodiment is provided, as the contact portion, a contact rib 36A in place of the contact boss 36 of the cartridge 30 in Embodiment 1. The contact rib 36A is provided on an upper surface of a cleaning frame 31A in an end side (driving side) end is a long plate-like member extending in mounting and demounting directions Y1 and Y2 of the cartridge 30.

The cartridge mounting portion 24 in the apparatus main assembly 1A side is provided with a contact portion guiding plate 24*a*. The contact portion guiding plate 24*a* is provided with a slit portion 24*b* through which the above-described contact rib 36A can pass. During insertion movement of the cartridge 30 into the cartridge mounting portion 24, the contact rib 36A passes through the slit portion 24*b* and then can enter an inside of the contact portion guiding plate 24*a*. Further, during pulling-out movement of the cartridge 30 from the cartridge p 24, the contact rib 36A passes through the slit portion 24*b* and can go out to an outside of the contact portion guiding plate 24*a*.

In this embodiment, movement of the cover 27, relative to the drive output coupling 26, between the protecting position A and the open position B is made by an operation of a link mechanism associated with the contact rib 36A described above. FIG. 9 is a perspective view of an example of the link mechanism.

The cover 27 is positioned in the guide groove 23R1 and is rotated in an up-down (vertical) direction, about the shaft portion 27*b* parallel to a rotational axis of the drive output coupling 26, thus being capable of moving the drive output coupling 26 between the protecting position A where the drive output coupling 26 is covered and the open position B where the drive output coupling 26 is exposed. The cover 27 is provided with an upward arm portion 27*e*. The arm portion 27*e* is provided with an elongated hole 27*f*.

Above the cover 27, a shaft portion 27*g* parallel to the rotational axis of the drive output coupling 26 is rotatably held and provided. In a position of the shaft portion 27*g* corresponding to the arm portion 27*e*, a downward connecting bar 27*h* is integrally provided with a lower end portion bent as a bent portion 27*i* in a position, of the shaft portion 27*g*, corresponding to the arm portion 27*e*. Further, the bent portion 27*i* is inserted into the elongated hole 27*f* of the arm portion 27*e*. That is, the connecting bar 27*h* and the arm portion 27*e* of the cover 27 are connected via the belt portion 27*i* and the elongated hole 27*f*.

Further, the shaft portion 27*g* in an end side is extended to a position corresponding to an inside of the contact portion guiding plate 24*a* and is provided, at the extended shaft portion end portion, with a downward flag plate portion 27*j* integrally formed with the shaft portion 27*g*. The shaft portion 27*g* is always rotationally urged in the counterclockwise direction X1 indicated by an arrow by an urging force of a torsion spring 27*c* as an urging member. During a free state, the cover 27 is held in the protecting position A where the cover 27 is urged against and received by the bottom (surface) of the guide groove 23R1 by the urging force of the torsion spring 27*e*. During this state, the flag plate portion 27*j* and the connecting bar 27*h* are in a downward attitude.

The above-described link mechanism is positioned and covered inside the guiding member 25R, the right side plate 23R and the contact portion guiding plate 24*a* so that the operator cannot move and open the cover 27 with the hand.

With reference to schematic views of FIG. 10, a moving operation of the cover 27 from the protecting position A to the open position B with movement of the cartridge 30 will be described.

Similarly as in Embodiment 1, the openable door 21 of the apparatus main assembly 1A is opened thereby to largely open the opening 22. Then, the first and second mounting and demounting guide bosses 35R1, 35L1, 35R2 and 35L2 of the cartridge 30 are engaged with the guide grooves 25R1 and 25L1 of the guiding members 25R and 25L, respectively. Then, the guide bosses 35R1, 35L1, 35R2 and 35L2 are moved along the guide grooves 25R1 and 25L1 to insert the cartridge 30 into the cartridge mounting portion 24 of the apparatus main assembly 1A. The drive input coupling 34 is engaged with the guide groove 23R1 and then is moved in the cartridge mounting direction Y along the guide groove 23R1.

Further, the contact rib 26A passes through the slit portion 24*b* of the contact portion guiding plate 24*a* to enter the contact portion guiding plate 24*a*. By further insertion movement of the cartridge 30, as shown in (a) of FIG. 10, the contact rib 36A contacts the downward flag plate portion 27*j* as a contacted portion of the link mechanism. With subsequent insertion movement of the cartridge 30, the flag plate portion 27*j* is pushed and moved rearward as shown in (b) of FIG. 10. For that reason, the shaft portion 27*g* and the connecting bar 27*h* integral therewith are rotated in the clockwise direction (arrow X2 direction in FIG. 9) in FIG. 10.

With the rotation of the connecting bar 27*h*, the cover 27 is rotated upward about the shaft portion 27*b* in the guide groove 23R1 from the protecting position A by the arm portion 27*e* connected with the connecting bar 27*h* via the bent portion 27*i* and the elongated hole 27*f*. As a result, the drive output coupling 26 is gradually exposed.

Then, when the cartridge 30 is sufficiently moved to a predetermined insertion position where the cartridge 30 abuts against a stopper portion (not shown), the cover 27 is rotationally moved to and held in a predetermined open position B by an opening operation by the link mechanism as shown in (c) of FIG. 10. In this state, the drive input coupling 34 in the cartridge 30 side is in an opposed state to the exposed drive output coupling 26 in the apparatus main assembly 1A side in a predetermined manner.

Then, as described above, by closing the openable door 21, the urging means performs the urging operation by the operation of the interrelating mechanism interrelated with the closing operation of the openable door 21, so that the cartridge 30 is urged against the positioning portion in the apparatus main assembly 1A side to be fixed and held in a positioning state in a predetermined mounting position. Further, the drive output coupling 26 in the apparatus main assembly 1A performs an engaging with the drive input coupling 34 in the cartridge 30 side. Further, the electrical contact portion for outputting the bias in the apparatus main assembly 1A side is in a connected state with the electrical contact portion in the cartridge 30 side. Thus, the cartridge 30 is in an image formable state.

In the case where the cartridge 30 is demounted from the cartridge mounting portion 24, the contact rib 36A is moved from the inside to the outside of the contact portion guiding portion 24*a* through the slit portion 24*b* with pulling movement of the cartridge 30 in the demounting direction Y2. That is, the contact rib 36A is moved in a direction in which the contact rib 36A is spaced from the flag plate portion 27*j*. As a result, the link mechanism is reversely operated, so that the cover 27 is returned and moved from the open position B to the protecting position A by the urging force of the torsion spring 29*c* and by gravitation with respect to the flag plate portion 27*j*, the connecting bar 27*h* and the cover 27 in a reverse operation process in the order of (c), (b) and (a) of FIG. 10.

Thus, when the cartridge 30 is taken out, the cover 27 is constituted to be placed in a state in which the cover 27 is positioned in the protecting position A and the drive output coupling 26 is covered relative to the cartridge mounting portion 24. Thus, during a state in which the cartridge 30 is taken out of the apparatus main assembly 1A, the operator cannot easily touch the drive output coupling 26, so that it becomes possible to protect the drive output coupling 26.

Embodiment 3

In Embodiment 3, a constitution in which a cartridge and a drive output coupling of an apparatus main assembly are protected will be described. FIG. 11 is a perspective view showing a state when a cartridge 130 is mounted to an image forming apparatus 100 in this embodiment. From Embodiments 1 and 2, a constitution of a protecting member for protecting the drive output coupling and a constitution for moving are different, and therefore a characteristic portion of these constitutions will be described, and constitutions identical to those in Embodiments 1 and 2 will be omitted from description.

(Cartridge)

First, the cartridge 130 in this embodiment will be described with reference to FIG. 12. Parts (a) and (b) of FIG. 12 are perspective views each showing an outer appearance of the cartridge 130. At a right side surface portion, a drive input coupling 134 as a drive-transmitted member is provided.

Around the drive input coupling 314, a flange 137 as an urged portion (portion-to-be-urged) is provided. Further, at right and left side surface portions, as guided members (members-to-be-guided), first mounting and demounting guide bosses 135R1 and 135L1 are provided, respectively, in a bilaterally symmetrical manner, and second mounting and demounting guide bosses 135R2 and 135L2 are provided, respectively, in the bilaterally symmetrical manner. Further, at an upper surface, two contact ribs 136A and 136B as first and second mounting and demounting contact portions, respectively, are provided. Each of these contact ribs 136A and 136B is a long plate-like member extending in mounting and demounting directions Y1 and Y2, and is a projection projected from the surface of a frame of the cartridge 130.

(Protecting Member)

Next, the constitution of the protecting member for protecting the drive output coupling 126 of the apparatus main assembly 101A will be described. Parts (a) and (b) of FIG. 13 are schematic perspective views showing the constitution for protecting the drive output coupling, in which (a) shows the constitution when the apparatus main assembly 101A is viewed from above in an obliquely leftward direction, and (b) shows the constitution when the apparatus main assembly 101A is viewed from above in an obliquely rightward direction. Parts (a) and (b) of FIG. 16 are schematic views for illustrating an operation of a cartridge lever as the protecting member.

As shown in (a) of FIG. 13 and FIG. 16, a constitution in which in a status in which the cartridge 130 is not mounted in the apparatus main assembly 101A, similarly as in Embodiment 1, a drive output coupling 126 is protected by a cartridge lever 190 so as not to be exposed to a mounting region of the cartridge 130 is employed. A position of the cartridge lever 190 shown in (a) of FIG. 13 and FIG. 16 is a protecting position. At this time, the cartridge lever 190 limits movement of the cartridge lever 190 from the protecting position by engaging a slide pin 211, as a part of a limiting member, with a round hole 196 of the cartridge lever 190. Further, in the case where the cartridge 130 as a cartridge adaptable to the apparatus main assembly 101A is mounted, a connecting means moves, in interrelation with the mounting operation of the cartridge 130, a slide cam 210 as a limiting member provided with the slide pin 211. Then, the engagement of the slide pin 211 with the round hole 196 of the cartridge lever 190 is eliminated. Here, the connecting means is constituted by a main lever 160, a sub-lever 170, a lever link 180, a main lever bearing 230, a cam link 220 and the like. A constitution of the connecting means will be described later specifically. As shown in (a) and (b) of FIG. 16, by the elimination of the engagement between the slide pin 211 and the cartridge lever 190, the flange 137 provided on the cartridge 130 urges the cartridge lever 190. Then, as shown in (b) of FIG. 16, the drive output coupling 126 is moved to an open position where the drive output coupling 126 is capable of being exposed to the mounting region of the cartridge 130. Then, by closing the openable door provided to the apparatus main assembly 101A similarly as in Embodiment 1, the drive output coupling 126 is moved in an axial direction, and thus is engaged with the drive input coupling 134 of the cartridge 130.

(Constitution of Connecting Means)

The connecting means will be described. As described above, the connecting means is constituted by the main lever 160, the sub-lever 170, the lever link 180, the main lever bearing 230, the cam link, a lever holder 150 and the like.

The lever holder 150 is provided on an upper stay 241 of the apparatus main assembly 101A, and the cartridge 130 is positioned at an upper surface when the cartridge 130 is mounted to the apparatus main assembly 101A. Further, the lever holder 150 is provided with a guiding plate 151. The guiding plate 151 includes two slit portions 152*a* and 152*b* through which the contact ribs 136A and 136B of the cartridge 130 can pass. Further, at a surface of the upper stay 241 opposite from the surface where the guiding plate 151 is provided, the main lever 160 as a second connecting member and the sub-lever 170 as a first connecting member are rotatably supported. The sub-lever 170 and the main lever 160 are rotatably connected at end portions of the lever link 180, so that 4-nodal point link mechanism is constituted.

Parts (a) and (b) of FIG. 14 are schematic sectional views for illustrating an operation of the sub-lever, and (a) to (c) of FIG. 15 are schematic sectional views for illustrating an operation of the main lever. Further, (a) to (e) of FIG. 19 are perspective views of the main lever 160, the sub-lever 170, the lever link 180, a base cam 200 and a slide cam 210, respectively. With respect to the sub-lever 170, rotation center shafts 171*a* and 171*b* are rotatably supported by sub-lever supporting portions 153*a* and 153*b* of the lever holder 150 ((b) of FIG. 13 and (b) of FIG. 19). The sub-lever 170 is provided with a contact portion 172, and the contact portion 172 is disposed in a hole 155*a* provided in the slit portion 152*a* of the lever holder 150 ((a) of FIG. 14). A rotation locus 174 of the contact portion 172 overlaps a movement region 136A1 of the contact rib 136A when the cartridge 130 is mounted. The movement region 136A1 is a region under a broken line indicated in FIG. 14. For that reason, the contact rib 136A of the cartridge 130 urges the contact portion 172 of the sub-lever 170, so that the sub-lever 170 can be rotated. The sub-lever 170 is, as described above, rotatably connected with a sub-lever connecting portion 181 of the lever link 180 at a lever link supporting portion 173 ((b) of FIG. 13 and (c) of FIG. 19).

Further, with respect to the main lever 160, rotation center shafts 161*a* and 161*b* are rotatably supported by main lever supporting portions 154*a* and 154*b* of the lever holder 150 ((b) of FIG. 13 and (a) of FIG. 19). Further, a rotation center shaft 161*c* is rotatably supported by a shaft supporting portion 231 of a main lever bearing 230 provided on a right side plate 123R. The main lever supporting portions 154*a* and 154*b* of the lever holder 150 and the shaft supporting portion 231 of the main lever bearing 230 are substantially coaxially disposed.

Further, as shown in (a) of FIG. 15), the main lever 160 is provided with a contact portion 162, and the contact portion 162 is disposed so as to be projected from a hole 155*b* provided in the slit portion 152*b* of the lever holder 150. A rotation locus 164 of the contact portion 162 overlaps a movement region 136B1 of the contact rib 136B when the cartridge 130 is mounted. For that reason, the contact rib 136B of the cartridge 130 urges the contact portion 162 of the main lever 160, so that the main lever 160 can be rotated. The main lever 160 is rotatably connected with a main lever connecting portion 182 of the lever link 180 at a lever link supporting portion 163 ((b) of FIG. 13 and (c) of FIG. 19).

FIG. 17 is a schematic right side view principally showing the main lever bearing 230 and the cartridge lever 220. The main lever bearing 230 is provided with the main lever 160 and abutment portions 232 and 233, which contact bearing contact portions 165 and 166, respectively, of the main lever 160, so that an amount of rotation of the main lever 160 is limited. The main lever 160 is urged in P direction by a spring 250 ((b) of FIG. 13). The spring 250 is a torsion spring and is engaged with a spring bearing portion 167 provided on the main lever 160 and with a spring holding portion 156 provided on the lever holder 150. For that reason, in a state in which the cartridge 130 is not mounted to the apparatus main assembly 101A, the main lever 160 is positioned in a position where the bearing contact portion 165 contacts the abutment portion 232 of the main lever bearing 230. In this position, as shown in (a) of FIG. 15, the contact portion 162 of the main lever 160 is retracted upward from an upper end of the locus 136B1 of the contact rib 136B of the cartridge 130. The sub-lever 170 is positioned through the lever link 180, and as shown in (a) of FIG. 14, the contact portion 172 of the sub-lever 170 is positioned in the movement region 136A1 of the contact rib 136A of the cartridge 130.

(Operation of Protecting Member and Limiting Member)

Parts (a) and (b) of FIG. 16 are schematic views for illustrating an operation of the cartridge lever 190. With respect to the cartridge lever 190, a rotation center shaft 191*b* is rotatably supported by the right side plate 123R and the cartridge guiding member 125R. The cartridge lever 190 is urged in Q direction by a lever spring 251. The lever spring 251 is a compression spring and is mounted at ends thereof between a spring bearing surface 192 provided on the cartridge lever 190 and a boss 125R2 provided on the cartridge guiding member 125R. The cartridge lever 190 is provided with an abutment portion 193, and the abutment portion 193 contacts a cartridge lever abutment portion 240 provided in the apparatus main assembly 101A, thus limiting an amount of rotation of the cartridge lever 190. For that reason, in the state in which the cartridge 130 is not mounted in the apparatus main assembly 101A, as shown in (a) of FIG. 16, the cartridge lever 190 is contacted, at the abutment portion 192, to the cartridge lever abutment portion 240 provided in the apparatus main assembly 101A and thus is positioned. When the cartridge lever 190 is located in this position, a coupling protecting portion 197 covers the drive output coupling 126. The cartridge lever 190 is provided with a contact portion 194 to be contacted to the flange 137 of the cartridge 130 when the cartridge 130 is mounted to the apparatus main assembly 101A. Further, as shown in (b) of FIG. 16, the contact portion 194 contacts the flange 137 of the cartridge 130 and then urges and presses the cartridge 130 in Q direction when the mounting of the cartridge 130 to the apparatus main assembly 101A is completed. Further, the cartridge lever 190 is provided with a cartridge urging portion 195 for abutting the cartridge 130 against a positioning portion (not shown) of the apparatus main assembly 101A to position the cartridge 130. The cartridge lever 190 is provided with a round hole 196 into which the slide pin 211 provided on the slide cam 210 is to be inserted. In a state in which the slide pin 211 is inserted into the round hole 196, the cartridge lever 190 cannot be rotated and thus in a locked state, and in a state in which the slide pin 211 is disconnected from the round hole 196, the cartridge lever 190 can be freely rotated (FIG. 18). At this time, a position of the slide pin 211 is a limiting position. The insertion and pulling of the slide pin 211 are carried out by rotating the slide cam 210 in U1 direction or U2 direction relative to a base cam 200 to move the slide cam 200 in an axial direction of the slide pin 211. The base cam 200 is provided in an opposite side of the right side plate 123R from a side where the cartridge 130 is mounted ((b) of FIG. 13). As shown in (d) of FIG. 19, the base cam 200 is provided with a hole 201 at its central portion, and is engaged with the slide pin 211 to rotatably and slidably support the slide cam 210. Further, the base cam 200 is provided with a cam surface 202 coaxially with the hole 201. The cam surface 202 consists of a bottom surface 202*a*, an inclined surface 202*b* and a top (upper) surface 202*c*. Further, as shown in (e) of FIG. 19, the slide cam 210 is provided with the slide pin 211 at its central portion. Further, the slide cam 210 is provided with a cam surface 212 coaxially with the slide pin 211. The cam surface 212 consists of a flat surface 212*a* and an inclined surface 212*b*. The slide cam 210 is mounted to the base cam 20 so that the cam surface of the base cam 200 and the cam surface 212 of the slide cam 210 oppose each other. Further, a cam urging spring 252 is provided so that the cam surface 202 of the base cam 200 and the cam surface 212 of the slide cam 210 are always contacted to each other, and urges the slide cam 210 in T direction ((b) of FIG. 13). The cam urging spring 252 is a compression spring, and is mounted at ends thereof between a spring bearing surface 213 provided on the slide cam 210 and a spring bearing surface (not shown) provided in the apparatus main assembly 101A side.

Parts (a) to (c) of FIG. 18 are schematic views for illustrating a locking operation of the cartridge lever 190, and (a) to (d) of FIG. 20 are schematic views each showing a phase between the base cam 200 and the slide cam 210. In a state in which the bottom surface 202*a* of the cam surface 202 of the base cam 200 and the flat surface 212*c* of the cam surface 212 of the slide cam 210 are contacted to each other ((a) of FIG. 20), the slide pin 211 is inserted into the round hole 196 of the cartridge lever 190 ((a) of FIG. 18). From this state, when the slide cam 210 is rotated in U1 direction (FIG. 17), the contact state between the bottom surface 202*a* of the base cam 200 and the flat surface 212*c* of the slide cam 210 are kept for a while ((b) of FIG. 20). Then, when the slide cam 211 is further rotated, the inclined surface 212*b* of the slide cam 210 rides along the inclined surface 202*b* of the base cam 200 ((c) of FIG. 20), so that the top surface 202*c* of the base cam 200 and the flat surface 212*c* of the slide cam 210 contact each other ((d) of FIG. 20). As a result, by transition from a state of (a) of FIG. 20 to a state of (b) of FIG. 20, the sub-lever 190 slides by a distance corresponding to a height h of the base cam 200. As a result, in (d) of FIG. 20, the slide pin 211 is in a disconnected state from the round hole 196 of the cartridge lever 190 ((b) of FIG. 18). A position of the slide pin 211 in this state is a permitting position.

Further, as shown in FIG. 17, the rotation of the slide cam 210 is made by transmitting a rotational force of the main lever 160 to the slide cam 210 via the cam link 220 as a third connecting member. That is, each of the main lever 160 and the slide cam 210 is rotatably connected with the cam link 220 at an associated end portion of the cam link 220. The main lever 160 is rotatably connected with a main lever connecting portion 221 of the cam link 220. The slide cam 210 is rotatably connected with a slide cam connecting portion 222 of the cam link 220.

(Detailed Operation of Connecting Means)

Details of the operation of the connecting means will be described.

In a state in which the openable door (not shown) of the apparatus main assembly 101A is open but the cartridge 130 is not mounted, as described above, the cartridge contact portion 162 of the main lever 160 is retracted above the movement region 136B1 of the contact rib 136A of the cartridge 130 ((a) of FIG. 15). A position of the main lever 160 at this time is a retracted position. The contact portion 172 of the sub-lever 170 is positioned in the movement region 136A1 of the contact rib 136A of the cartridge 130 ((a) of FIG. 14). A phase of the base cam 210 relative to the base cam 200 is determined from the position of the main lever 160 through the cam link 220. The slide cam 210 in a state of (a) of FIG. 14 is in a state in which the flat surface 212*a* of the cam surface 212 of the slide cam 210 contacts the bottom surface 202*a* of the base cam 200 as shown in (a) of FIG. 20. Accordingly, the slide pin 211 of the slide cam 210 is inserted into the round hole 196 of the cartridge lever 190, so that the cartridge lever 190 cannot be rotated and thus is in the locked state ((a) of FIG. 18).

Further, as described above, the coupling protecting portion 197 of the cartridge lever 190 covers the drive output coupling 126 ((a) of FIG. 16). For that reason, in a state in which the cartridge 130 is taken out of the apparatus main assembly 101A, the user (operator) cannot easily touch the drive output coupling 126, so that the drive output coupling 126 is protected. Further, the cartridge lever 190 is locked, and therefore the user cannot exposure the drive output coupling 126 by pushing up the cartridge lever 190.

A mounting operation of the cartridge 130 to the apparatus main assembly 101A will be described. The first and second mounting and demounting guide bosses 135R1, 135L1, 135R2 and 135L2 of the cartridge 130 are engaged with the guide grooves (including the right-side guide groove 125R1) provided in the right-side guiding member 125R and a left-side guiding member (not shown) ((a) of FIG. 13). Then, the guide bosses 135R1, 135L1, 135R2 and 135L2 are moved along the guide grooves, so that the cartridge 130 is inserted into the mounting portion 124. The cartridge 130 is moved in Y1 direction. At that time, the contact ribs 136A and 136B passes through the slit portions 152*a* and 152*b*, respectively, to enter an inside of the lever holder 150. By further inserting the cartridge 130, as shown in (a) of FIG. 14, the contact rib 136A contacts the contact portion 172 of the sub-lever 170. Then, when the cartridge 130 is further inserted, the contact portion 172 is moved rearward in W direction while passing through the locus 174 as shown in (b) of FIG. 14. At this time, the main lever 160 is connected with the sub-lever 170 via the lever link 180, and therefore also the main lever 160 is rotated in Z direction with rotation (from ((a) to (b) of FIG. 14) of the sub-lever 170. Then, the cartridge contact portion 162 of the main lever 160 passes through a locus 164 to be moved from a position of (a) of FIG. 15 to a position of (b) of FIG. 15. That is, the cartridge contact portion 162 moves from a position where the cartridge contact portion 162 is retracted from a locus 136B1 of the contact rib 136B of the cartridge 130 to a position in the locus 136B1. In this state, a position of the main lever 160 is an entered position. At this time, the slide cam 210 is connected with the main lever 160 via the cam link 220, and therefore also the slide cam 210 is rotated in U1 direction with rotation (from (a) to (b) of FIG. 15) of the main lever 160. As a result, the phase of the slide cam 210 relative to the base cam 200 is changed from the state shown in (a) of FIG. 20 to the state shown in (b) of FIG. 20. That is, the slide cam 210 is only rotated, so that the slide pin 211 is not moved in a thrust direction. As a result, the slide pin 211 is still inserted in the round hole 196 of the cartridge lever 190, so that the cartridge lever 190 cannot rotate as yet and thus the locked state thereof is not changed.

Then, by further inserting the cartridge 130 into the mounting portion 124, the contact rib 136B of the cartridge 130 and the cartridge contact portion 162 of the main lever 160 are contacted to each other. Then, when the cartridge 130 is further inserted, the cartridge contact portion 162 passes through the locus 164 in Z direction to be moved from the position of (b) of FIG. 15 to the position of (c) of FIG. 15. With rotation (from (b) to (c) of FIG. 15) of the main lever 160, also the slide cam 210 is rotated in U1 direction. As a result, the phase of the slide cam 210 relative to the base cam 200 is changed from the state shown in (b) of FIG. 20 to the state shown in (d) of FIG. 20. In this state, a position of the main lever 160 is an operation position. That is, the slide cam 210 not only rotates but also slides in the axial direction by a distance corresponding to a height h of the base cam 200. As a result, the slide pin 211 is in a disconnected state from the round hole 196 of the cartridge lever 190, so that the lock is eliminated ((b) of FIG. 18).

When the cartridge 130 is further inserted into the mounting portion 124, the flange 137 of the cartridge 130 is contacted to the contact portion 194 of the cartridge lever 190 ((a) of FIG. 16). When the cartridge 130 is subsequently inserted, the cartridge lever 190 is urged by the flange 137, and is rotated in V direction against an urging force of a lever spring 251. That is, the cartridge lever 190 is moved from the protecting position, where the drive output coupling 126 is protected, to the open position, and thus the drive output coupling 126 is gradually exposed ((c) of FIG. 18).

Then, when the cartridge 130 is moved to a predetermined mounting position, as shown in (b) of FIG. 16, the flange 137 of the cartridge 130 is contacted to the cartridge urging portion 195 of the cartridge lever 190. In this state, a position of the cartridge lever 190 is the open position. In this state. In this state, the drive input coupling 134 of the cartridge 130 is in an opposing state to the exposed drive input coupling 126. That is, by mounting the cartridge 130, the cartridge lever 190 is retracted from the protecting position to the open position, so that the drive input coupling 134 is in an engageable state with the drive output coupling 126.

Further, by a lever spring 251, the cartridge lever 190 urges the cartridge 130 in Q direction through the flange 137. For that reason, the cartridge 130 is urged against a positioning portion (not shown) in the apparatus main assembly 101A, and is fixed and held in a positioned state in a predetermined mounting position. By the above-described operation, the cartridge 130 is mounted into the apparatus main assembly 101A.

As described above, the cartridge lever 190 not only protects the drive output coupling 126 but also performs the urging for positioning the cartridge 130 in the apparatus main assembly 101A. For that reason, compared with the case where the protection and the urging are performed by separate members, the apparatus main assembly 101A can be downsized.

(Demounting of Cartridge)

In the case where the cartridge 130 is demounted from the predetermined mounting position, the cartridge 130 is moved in Y2 direction. Then, the cartridge lever 190 is moved from the open position ((b) of FIG. 16) to the protecting position ((a) of FIG. 16). When the cartridge 130 is further moved, the cartridge contact portion 162 of the main lever 160 is moved from the riding state ((c) of FIG. 15) on the contact rib 136B of the cartridge 130. The main lever 160 is urged in P direction and therefore is rotated in P direction ((b) of FIG. 15), and the sub-lever 170 is in a state shown in (b) of FIG. 14. In this case, the slide cam 210 is rotated in U2 direction (FIG. 17). As a result, the phase of the slide cam 210 relative to the base cam 200 is changed from the state shown in (d) of FIG. 20 to the state shown in (b) of FIG. 20. That is, the slide cam 210 not only rotates but also slides by a distance corresponding to the height h of the base cam 200. As a result, in (b) of FIG. 20, the slide pin 211 is in the inserted state into the round hole 196 of the cartridge lever 190, so that the cartridge lever 190 is locked.

When the cartridge 130 is further moved, the contact portion 172 of the sub-lever 170 is moved from the riding state ((b) of FIG. 14) on the contact rib 136A of the cartridge 130. The main lever 160 is urged in P direction, and therefore also the sub-lever 170 is rotated similarly in P direction ((a) of FIG. 14), so that the main lever 160 is in the state shown in (a) of FIG. 15. By the above-described operation, the cartridge 130 is taken out from the apparatus main assembly 101A.

As described above, the positions of the contact ribs 136A and 136B of the cartridge 130 corresponding to the positions of the slit portions 152*a* and 152*b* of the lever holder 150, so that the lock of the cartridge lever 190 is eliminated. Then, the cartridge 130 can be mounted into the apparatus main assembly 101A. For that reason, even when the user (operator) puts a finger or an object in the slit portion 152*a* or 152*b*, the lock of the cartridge lever 190 is not eliminated until the user puts fingers or objects in both of the slit portions 152*a* and 152*b*. For that reason, it becomes possible to more reliably protect the drive output coupling 126 from an erroneous operation of the user.

Other Embodiments

1) With respect to functions, materials, shapes and relative arrangement of constituent elements (portions) described in Embodiments 1 and 3, the scope of the present invention is not intended to be limited thereto unless otherwise specified particularly.

2) In the present invention, the image forming apparatus is not limited to the electrophotographic image forming apparatus described in Embodiments 1 to 3. The image forming apparatus includes image forming apparatuses in which the image is formed on the recording material by using various known image forming principles and types, such as an electrostatic recording process and a magnetic recording process.

3) The image forming apparatus is not limited to an image forming apparatus to which a single cartridge is detachably mountable. The image forming apparatus includes an image forming apparatus in which a plurality of cartridges such as those for different colors are detachably mounted to predetermined mounting portions, respectively, and then color images or the like are formed.

4) The cartridge is not limited to the integral type process cartridge used in Embodiments 1 to 3. The cartridge includes the separation type process cartridge in which the image forming process means actable on the image bearing member on which the image is to be formed, and includes the developing cartridge provided with the developing means for developing, with the developer, the latent image formed on the image bearing member on which the image is to be formed. In this case, the drive-transmitted member transmits the driving force to the developing roller as the developing means, a supplying roller for supplying the developer to the developing roller, the feeding member for feeding the developer, and the stirring member for stirring the developer. Further, the cartridge includes the developer cartridge for accommodating the developer used in the developing means for developing the latent image formed on the image bearing member. In this case, the drive-transmitted member transmits the driving force to the feeding member for feeding the developer and the stirring member for stirring the developer. In addition, the cartridge includes a unit which is detachably mounted to the apparatus main assembly and which contributes to the image forming process for forming the image on the recording material.

According to the present invention, it is possible to not only prevent access of the operator to the drive transmission image by an inexpensive constitution but also to protect the drive transmission member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 271267/2012 filed Dec. 12, 2012 and 232108/2013 filed Nov. 8, 2013, which are hereby incorporated by reference.

What is claimed is:

1. An image forming apparatus, to which a cartridge is detachably mountable, for forming an image on a recording material, comprising:

a mounting portion for mounting to the image forming apparatus when the cartridge performs an image forming operation;

a drive transmission member for transmitting a driving force by being engaged with a drive-transmitted member provided on the cartridge when the cartridge is mounted to said mounting portion; and a protecting member movable from a protecting position where said drive transmission member is prevented from engaging with the drive-transmitted member to an open position where said protecting member is retracted from the protecting position thereby to permit engagement of said drive transmission member with the drive-transmitted member, with said protecting member moving to the open direction during transference of the cartridge in an insertion direction.

2. An image forming apparatus according to claim 1, wherein said protective member is moved from the protecting position to the open position by being urged by the cartridge when the cartridge is mounted to said mounting portion.

3. An image forming apparatus according to claim 1, further comprising an urging member for urging said protecting member so as to return said protecting member from the open position to the protecting position.

4. An image forming apparatus according to claim 1, further comprising a limiting member movable between a permitting position where movement of said protecting member from the protecting position to the open position is permitted and a limiting position where the movement of said protecting member from the protecting position to the open position is limited.

5. An image forming apparatus according to claim 4, further comprising connecting means for moving said limiting member from the limiting position to the permitting position in interrelation with mounting of the cartridge to said mounting portion.

6. An image forming apparatus according to claim 5, wherein said connecting means includes a first connecting member movable in contact with the cartridge during mounting of the cartridge to the mounting portion, and a second connecting member, interrelated with said first connecting member, which is movable between a retracted position, retracted from a movement region through which the cartridge passes during the mounting of the cartridge to the mounting portion, an entered position where the cartridge enters the movement region from the retracted position by movement of said first connecting member, and an operating position to which said second connecting member is moved from the entered position by contact with the cartridge, and wherein said limiting member is moved from the limiting position to the permitting position by movement of said second connecting member to the operating operation.

7. An image forming apparatus according to claim 6, wherein said connecting means further includes a third connecting member for connecting said second connecting member with said limiting member.

8. An image forming apparatus according to claim 4, wherein said limiting member includes a shaft portion for limiting movement of said protecting member by being engaged with said protecting member in the limiting position and a cam portion for moving said shaft portion in an axial direction by being engaged with a second cam portion.

9. An image forming apparatus according to claim 3, wherein said protecting member urges the cartridge toward said mounting portion by being urged by the urging member to position the cartridge in a main assembly of said image forming apparatus.

10. A cartridge detachably mountable to a main assembly of an image forming apparatus for forming an image on a recording material, including: a mounting portion for mounting to the image forming apparatus when the cartridge performs an image forming operation; a drive transmission member; and a protecting member movable from a protecting position where said drive transmission member is prevented from engaging with a drive-transmitted member to an open position where the protecting member is retracted from the protecting position thereby to permit engagement of the drive transmission member with the drive-transmitted member, with said protecting member moving to the open position during transference of the cartridge in an insertion direction, said cartridge comprising:

said drive-transmitted member for receiving a driving force by being engaged with the drive transmission member when said cartridge is mounted to the mounting portion, wherein said drive-transmitted member is engageable with the drive transmission member by mounting said cartridge to the mounting portion to retract the protecting member from the protecting position to the open position.

11. A cartridge according to claim 10, further comprising a contact portion for moving the protecting member from the protecting position to the open position in contact with the protecting member when said cartridge is mounted to the mounting portion.

12. A cartridge according to claim 11, wherein the image forming apparatus further includes a limiting member movable, when said cartridge is mounted to the mounting portion, between a permitting position where movement of the protecting member from the protecting position to the open position is permitted and a limiting position where the movement of the protecting member from the protecting position to the open position is limited, and includes connecting means for moving the limiting member from the limiting position to the permitting position, wherein said cartridge further comprises a second contact portion for moving the limiting member in contact with the connecting means before the contact of said contact portion with the protecting member, and wherein said second contact portion moves the limiting member from the limiting position to the permitting position.

13. A cartridge according to claim 12, wherein the connecting means includes a first connecting member movable in contact with said cartridge during mounting of said cartridge to the mounting portion, and a second connecting member, interrelated with the first connecting member, which is movable between a retracted position, retracted from a movement region through which said cartridge passes during the mounting of said cartridge to the mounting portion, an entered position where said cartridge enters the movement region from the retracted position by movement of the first connecting member, and an operating position to which the second connecting member is moved from the entered position by contact with said cartridge, wherein said cartridge further comprises a third contact portion for moving the limiting member in contact with the second connecting member after contact of said second contact portion with the first connecting member, and wherein said third contact portion moves the limiting member from the limiting position to the permitting position.

14. A cartridge according to claim 13, wherein each of said second contact portion and said third contact portion is a projection projected from a surface of a frame provided as a part of said cartridge.

15. A cartridge according to claim 10, further comprising a portion-to-be-urged to be urged by the protecting member so as to position said cartridge in the main assembly of the image forming apparatus when said cartridge is mounted to the mounting portion.

16. A cartridge according to claim 10, which is a process cartridge including a member and process means actable on the photosensitive member, wherein said drive-transmitted member transmits the driving force to the photosensitive member.

17. A cartridge according to claim 10, which is a developing cartridge including developing means for developing a latent image formed on a photosensitive member, wherein said drive-transmitted member is a developing roller as the developing means, a feeding member for feeding a developer to the developing roller or a stirring member for stirring the developer.

18. A cartridge according to claim 10, which is a developer cartridge for accommodating a developer used in developing means for developing a latent image formed on a member, wherein said drive-transmitted member is a feeding member for feeding a developer or a stirring member for stirring the developer.

* * * * *